US008182109B2

(12) United States Patent
Matthews et al.

(10) Patent No.: US 8,182,109 B2
(45) Date of Patent: May 22, 2012

(54) LIGHTING DEVICE WITH SWITCHABLE LIGHT SOURCES

(75) Inventors: John W. Matthews, Newport Beach, CA (US); Michael D. Picciotta, Yorba Linda, CA (US); William Wells, Costa Mesa, CA (US)

(73) Assignee: SureFire, LLC, Fountain Valley, CA (US)

( * ) Notice: Subject to any disclaimer, the term of this patent is extended or adjusted under 35 U.S.C. 154(b) by 291 days.

(21) Appl. No.: 12/702,146

(22) Filed: Feb. 8, 2010

(65) Prior Publication Data

US 2010/0164401 A1 Jul. 1, 2010

Related U.S. Application Data

(63) Continuation-in-part of application No. 12/248,704, filed on Oct. 9, 2008.

(60) Provisional application No. 61/295,067, filed on Jan. 14, 2010.

(51) Int. Cl.
*F21L 4/04* (2006.01)

(52) U.S. Cl. ..... 362/199; 362/196; 362/197; 362/198; 362/200; 362/201; 362/202; 362/203; 362/204; 362/205; 362/206

(58) Field of Classification Search ..... 362/196–206
See application file for complete search history.

(56) References Cited

U.S. PATENT DOCUMENTS

| | | | |
|---|---|---|---|
| D95,274 | S | 4/1935 | Levy |
| D548,385 | S | 8/2007 | Sharrah et al. |
| 7,273,292 | B2 | 9/2007 | Kim |
| D567,894 | S | 4/2008 | Sterling et al. |
| D568,508 | S | 5/2008 | Howe et al. |
| D578,599 | S | 10/2008 | Cheng |
| 7,441,918 | B2 | 10/2008 | Kim |
| D581,586 | S | 11/2008 | Conroy |
| D585,516 | S | 1/2009 | Smith |
| 7,576,515 | B2 | 8/2009 | Greenslade |
| D600,772 | S | 9/2009 | Swan |

(Continued)

FOREIGN PATENT DOCUMENTS

WO WO 2010/042756 4/2010

OTHER PUBLICATIONS

U.S. Appl. No. 12/248,704, Matthews, John W.

(Continued)

*Primary Examiner* — William Carter
(74) *Attorney, Agent, or Firm* — Haynes and Boone, LLP

(57) ABSTRACT

Various lighting device implementations and related methods may be used to selectively provide various types of light in response to user-actuated controls. In one example, a lighting device includes a plurality of light sources, a body, a head, and one or more controls adapted to adjust operation of the light sources. The body includes a housing. The head includes a bezel adapted to rotate relative to the body to select between at least a first one of the light sources and a second one of the light sources. The head also includes a lens adapted to rotate eccentrically relative to a centerline of the head in response to rotation of the bezel. The lens includes a light inlet adapted to be selectively positioned over the first light source, the second light source, or neither of the light sources as the lens rotates eccentrically relative to the centerline of the head.

35 Claims, 24 Drawing Sheets

U.S. PATENT DOCUMENTS

| | | | |
|---|---|---|---|
| 7,614,760 | B2 | 11/2009 | Sharrah et al. |
| D612,970 | S | 3/2010 | Sharrah et al. |
| D616,956 | S | 6/2010 | Hamilton |
| 2004/0068913 | A1 | 4/2004 | Solinsky et al. |
| 2005/0122711 | A1 | 6/2005 | Matthews et al. |
| 2005/0122712 | A1 | 6/2005 | Kim |
| 2005/0157492 | A1 | 7/2005 | Chiu |
| 2005/0237737 | A1 | 10/2005 | Kim |
| 2007/0034890 | A1 | 2/2007 | Daschner et al. |
| 2007/0227056 | A1 | 10/2007 | Howe et al. |
| 2008/0134562 | A1 | 6/2008 | Teetzel |
| 2008/0155876 | A1 | 7/2008 | Matthews |
| 2008/0157114 | A1 | 7/2008 | Basin et al. |
| 2010/0046211 | A1 | 2/2010 | Spartano et al. |
| 2010/0091485 | A1 | 4/2010 | Matthews et al. |

OTHER PUBLICATIONS

PCT/US2009/060054, Oct. 8, 2009, SunFire, LLC.

LIGHTING DEVICE WITH SWITCHABLE LIGHT SOURCES

CROSS-REFERENCE TO RELATED APPLICATIONS

This application is a continuation-in-part application of U.S. patent application Ser. No. 12/248,704 entitled "SWITCHABLE LIGHT SOURCES" filed Oct. 9, 2008, which is hereby incorporated by reference in its entirety. This application claims the benefit of U.S. Provisional Patent Application Ser. No. 61/295,067 entitled, "LIGHTING DEVICE WITH SWITCHABLE LIGHT SOURCES" filed Jan. 14, 2010, which is hereby incorporated by reference in its entirety.

BACKGROUND

1. Field of the Invention

The present invention generally relates to light producing devices and more particularly relates to light producing devices with switchable light sources.

2. Related Art

As is well known, light producing devices are typically configured to perform only a single function, namely, to illuminate areas of interest. For example, conventional lighting devices are typically implemented with mechanical and electrical structures directed to performing this single function.

Unfortunately, such conventional lighting devices have various limitations. For example, although such devices are useful for illumination with white light, there are often instances when illumination with other colors of visible light is desirable. There are also instances when illumination with infrared light, ultraviolet, light, or other wavelengths is desirable. Accordingly, there is a need for an improved lighting device that overcomes one or more of the deficiencies discussed above.

SUMMARY

A lighting device is provided which may be operated to selectively provide various types of light, such as light of different wavelengths, in response to user-actuated controls. Related methods of operation are also provided.

In one embodiment, a lighting device includes a plurality of light sources, a body, a head, and one or more controls adapted to adjust operation of the light sources. The body includes a housing. The head includes a bezel adapted to rotate relative to the body to select between at least a first one of the light sources and a second one of the light sources. The head also includes a lens adapted to rotate eccentrically relative to a centerline of the head in response to rotation of the bezel. The lens includes a light inlet adapted to be selectively positioned over the first light source, the second light source, or neither of the light sources as the lens rotates eccentrically relative to the centerline of the head.

In another embodiment, a method of operating a lighting device is provided. The lighting device includes a plurality of light sources, a head including a bezel, a lens, and a lock ring, a body including a housing, and one or more controls adapted to adjust operation of the light sources. The method includes urging the lock ring from a locked position to an unlocked position. The lock ring is adapted to prevent rotation of the bezel while the lock ring is in the locked position and permit rotation of the bezel while the lock ring is in the unlocked position. The method also includes rotating the bezel to select a first one of the light sources or a second one of the light sources. The rotating causes the lens to rotate eccentrically relative to a centerline of the head. The lens includes a light inlet adapted to be selectively positioned over the first light source, the second light source, or neither of the light sources as the lens rotates eccentrically relative to the centerline of the head. The method also includes returning the lock ring to the locked position.

In another embodiment, a lighting system includes a lighting device. The lighting device includes a plurality of light sources, a body, a head, and one or more controls adapted to adjust operation of the light sources. The body includes a housing, a connector, and a mounting surface. The head includes a bezel adapted to rotate relative to the body to select between at least a first one of the light sources and a second one of the light sources. The head also includes a lens adapted to rotate eccentrically relative to a centerline of the head in response to rotation of the bezel. The lens includes a light inlet adapted to be selectively positioned over the first light source, the second light source, or neither of the light sources as the lens rotates eccentrically relative to the centerline of the head. The lighting system also includes a remote switch. The connector is adapted to receive the remote switch to control at least one of the light sources. The lighting system also includes a rail clamp mount. The mounting surface is adapted to engage with the rail clamp mount to attach the lighting device to a weapon.

In another embodiment, a lighting device includes a plurality of light sources, a body, a head, and one or more controls adapted to adjust operation of the light sources. The body includes a housing. The head includes a bezel adapted to rotate relative to the body to select between at least a first one of the light sources and a second one of the light sources. The head also includes a reflector adapted to rotate eccentrically relative to a centerline of the head in response to rotation of the bezel. The reflector comprises a light inlet adapted to be selectively positioned over the first light source, the second light source, or neither of the light sources as the reflector rotates eccentrically relative to the centerline of the head.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

In accordance with various embodiments provided herein, a lighting device may be implemented to selectively provide various types of light, such as light of different wavelengths, in response to user-actuated controls. For example, in one embodiment, such a lighting device may be a weapon-mountable lighting device providing convenient access to user controls for selectively configuring (e.g., adjusting) the operation of the lighting device. For example, such user controls may be used to adjust the switching of light sources as well as the brightness and wavelengths of light emitted by such light sources. In one embodiment, such light sources may be implemented with a plurality of light emitting diodes (LEDs) which may be selectively activated and selectively dimmed to provide light of different wavelengths. Light sources other than LEDs may be used in other embodiments.

Such a lighting device may be used in any desired combination with the various features identified in the present disclosure to provide a lighting system. In certain embodiments, such a lighting system may be particularly suited for use in tactical and combat environments (e.g., for mounting on weapons or other devices). In other embodiments, the lighting system may be used in any desired environment and for any desired application.

Figure 1A:
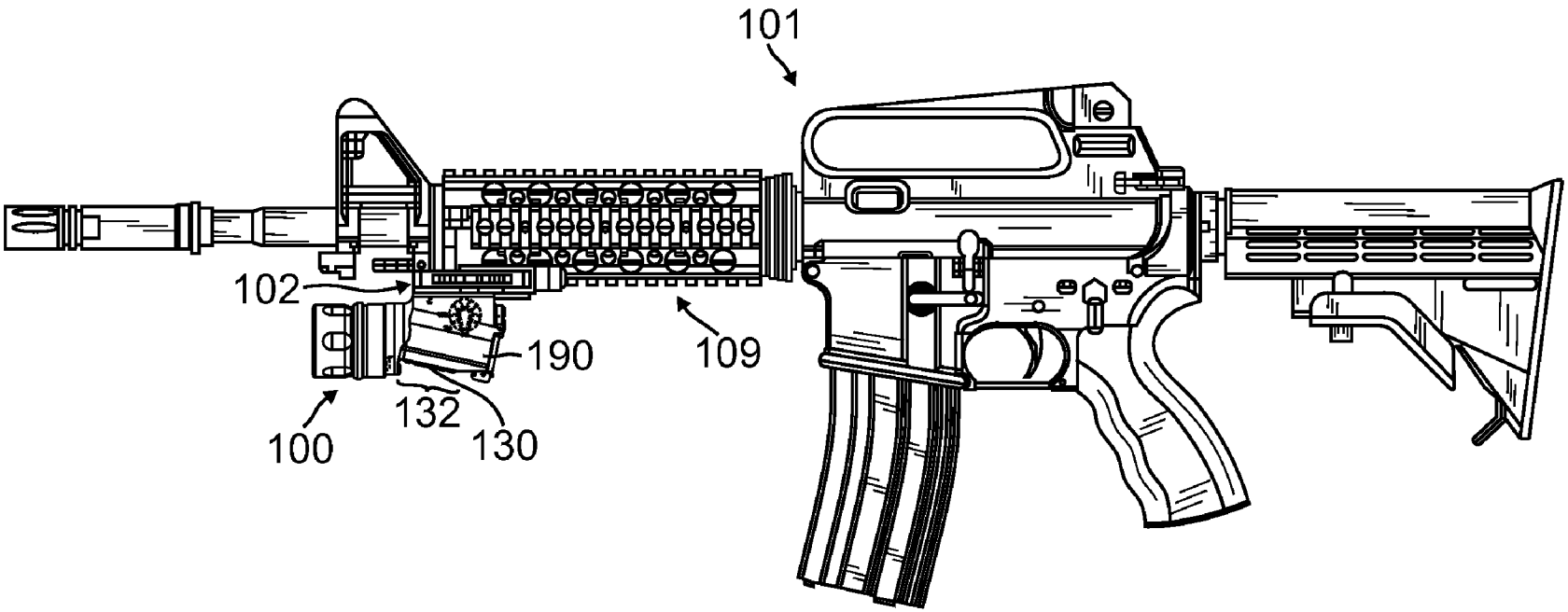
FIGS. 1A-C illustrate a lighting device attached to a weapon using various configurations in accordance with several embodiments of the invention.
Figure 1B:
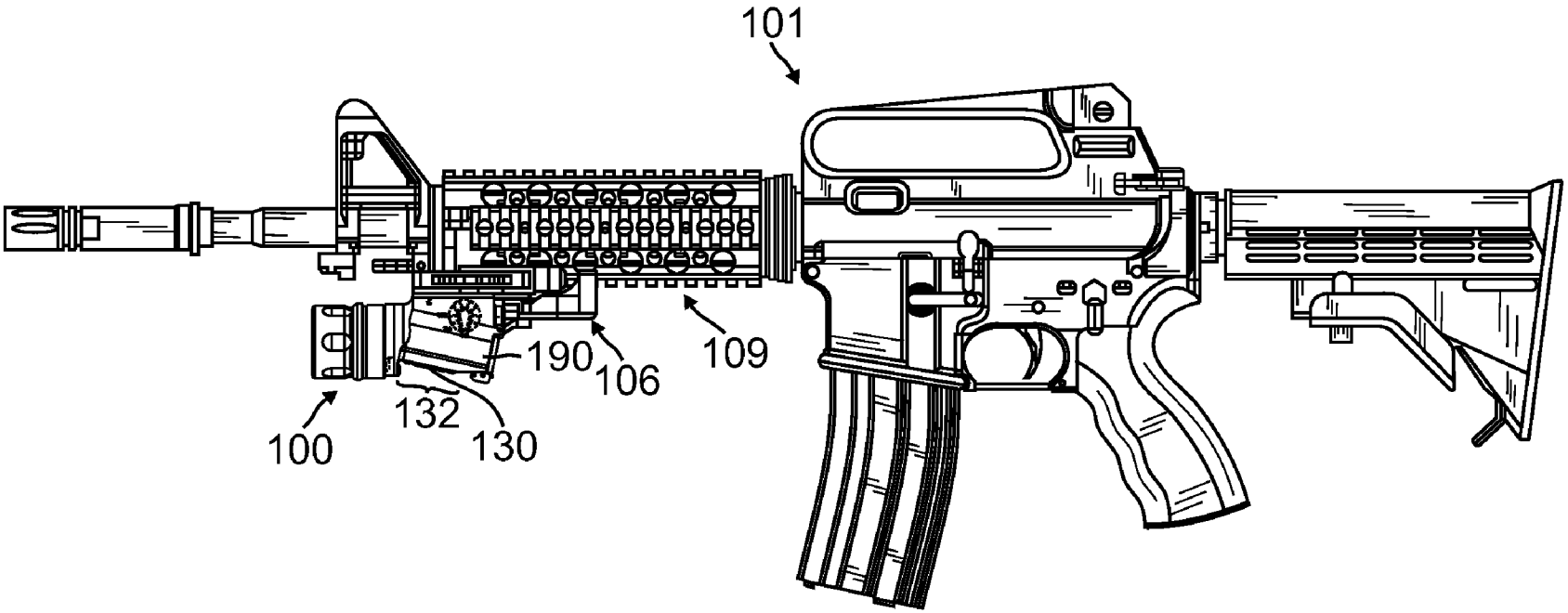
Figure 1C:
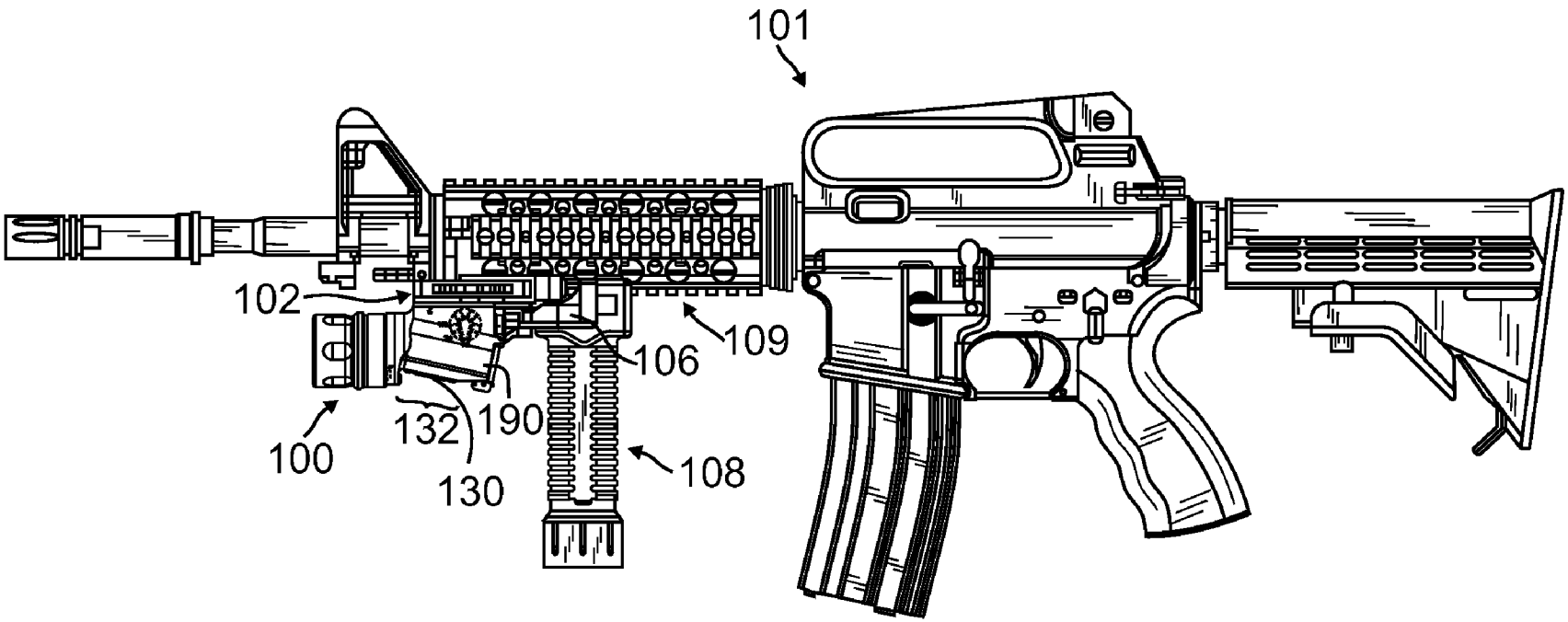

Referring now to the drawings wherein the showings are for purposes of illustrating embodiments of the present invention only, and not for purposes of limiting the same, FIGS. 1A-C illustrate a lighting device 100 attached to a weapon 101 using various configurations in accordance with several embodiments of the invention.

For example, as shown in FIG. 1A, lighting device 100 may be attached to a rail 109 of weapon 101 using a rail clamp mount 102. In one embodiment, rail clamp mount 102 may be implemented in accordance with a rail clamp mount described in U.S. patent application Ser. No. 11/646,870 entitled "RAIL CLAMP MOUNT" filed Dec. 27, 2006, which is hereby incorporated by reference herein in its entirety. In other embodiments, other rail clamp mounts may be used as appropriate.

As also shown in FIG. 1A, lighting device 100 includes an inclined external surface 132 which is inclined (e.g., angled) relative to rail 109 and a barrel of weapon 101 while lighting device 100 is attached to rail 109 by rail clamp mount 102. In one embodiment, inclined external surface 132 may be inclined relative to a centerline of a head of lighting device 100 and also inclined relative to a direction of light (e.g., light beams) provided by lighting device 100 (e.g., in FIG. 1A, lighting device 100 may provide light beams that are substantially parallel to the barrel of weapon 101). For example, in such an embodiment, inclined external surface 132 may be inclined approximately twelve degrees relative to the centerline and the direction of light. In other embodiments, other angles of inclination may be used.

Inclined external surface 132 may provide convenient access to a dome switch 130 of lighting device 100 by a user of weapon 101. In addition, the inclined external surface 132 and the external shape of a housing 190 of lighting device may permit the user to conveniently pull lighting device 100 toward the user while lighting device 100 is mounted on weapon 101 and the user is operating weapon 101.

Figure 2A:
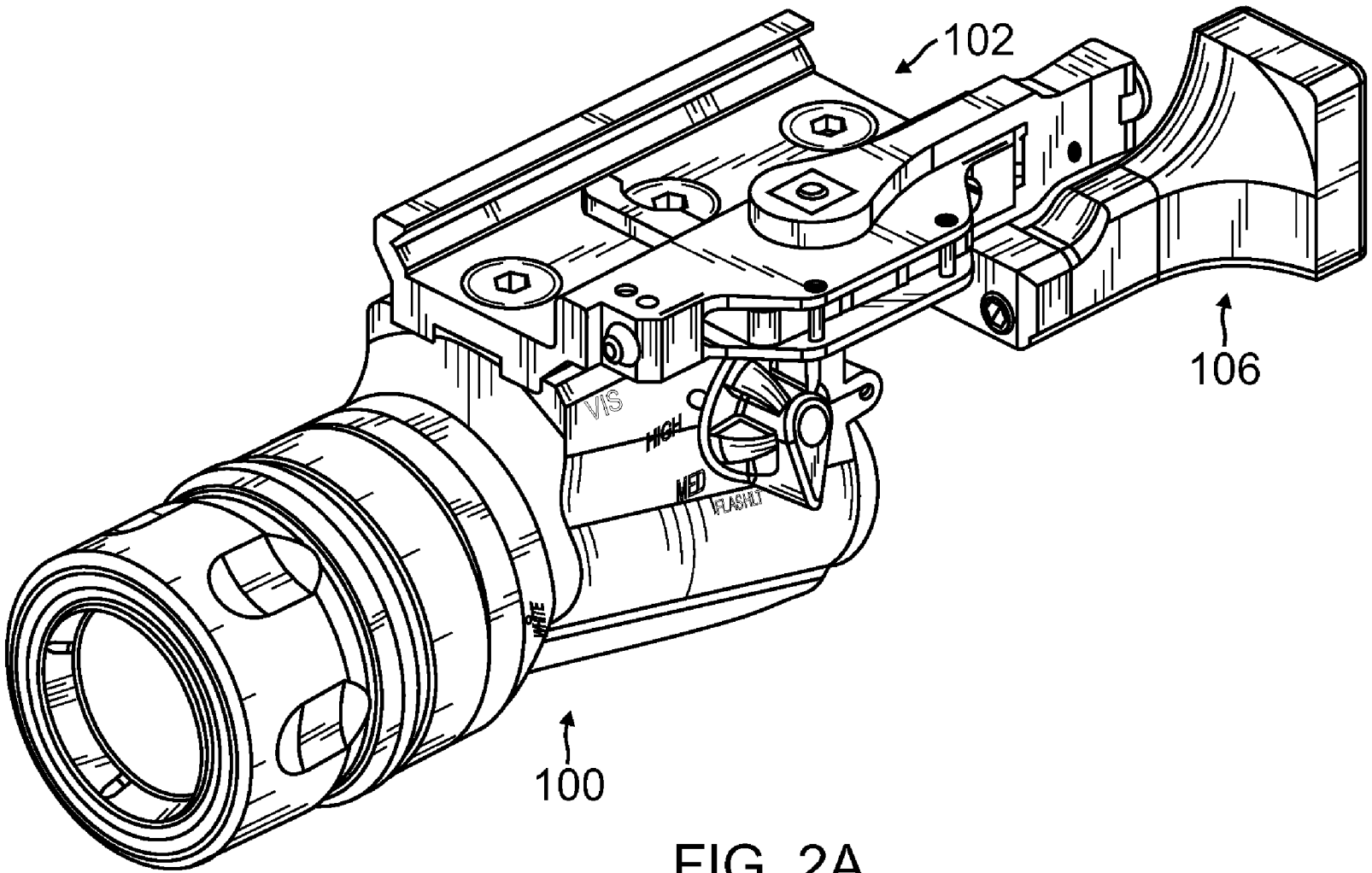
FIGS. 2A-B illustrate a lighting device connected to a switch and a rail clamp mount in accordance with several embodiments of the invention.
Figure 2B:
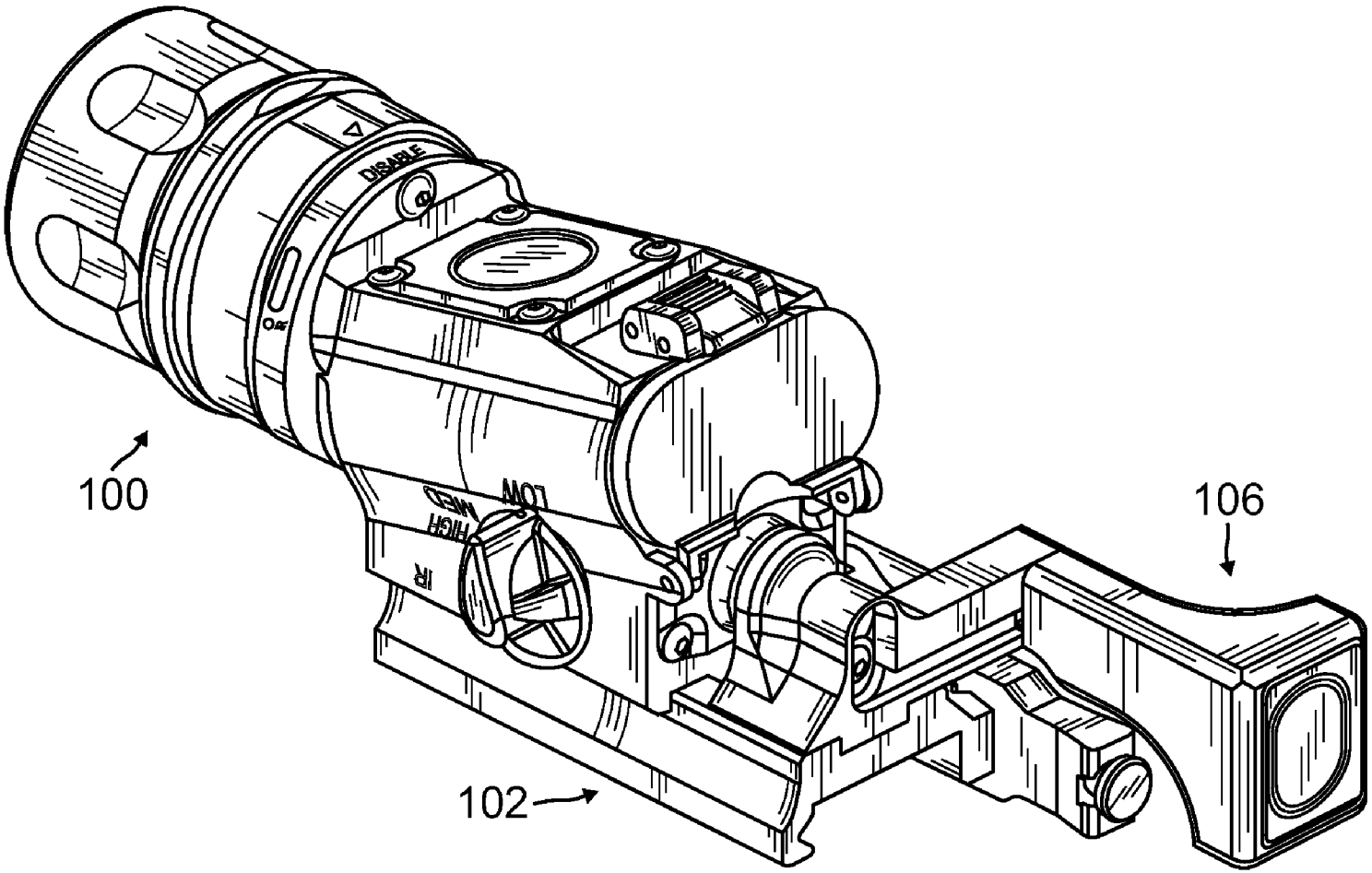
Figure 3A:
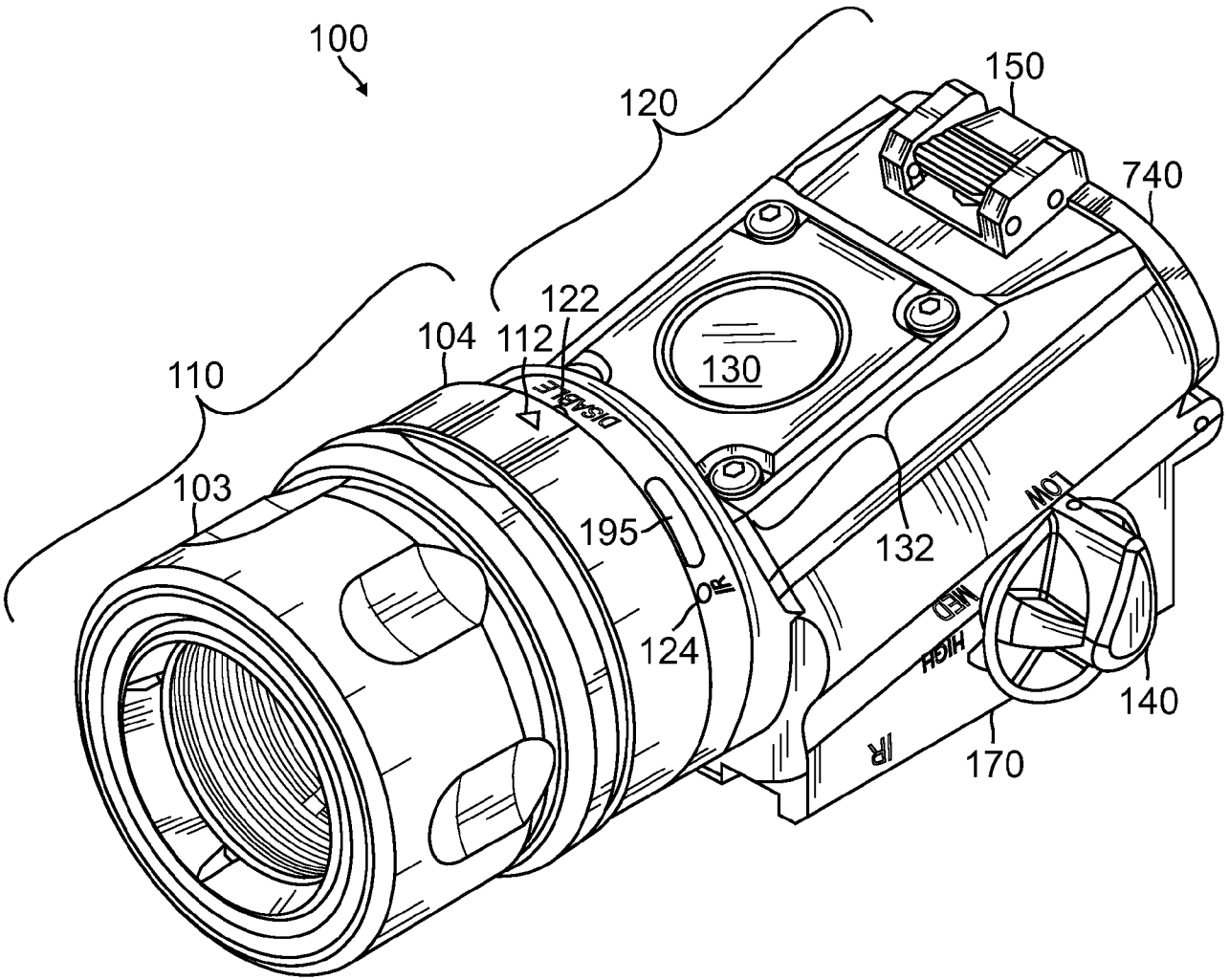
FIGS. 3A-H illustrate a lighting device in accordance with several embodiments of the invention.
Figure 3B:
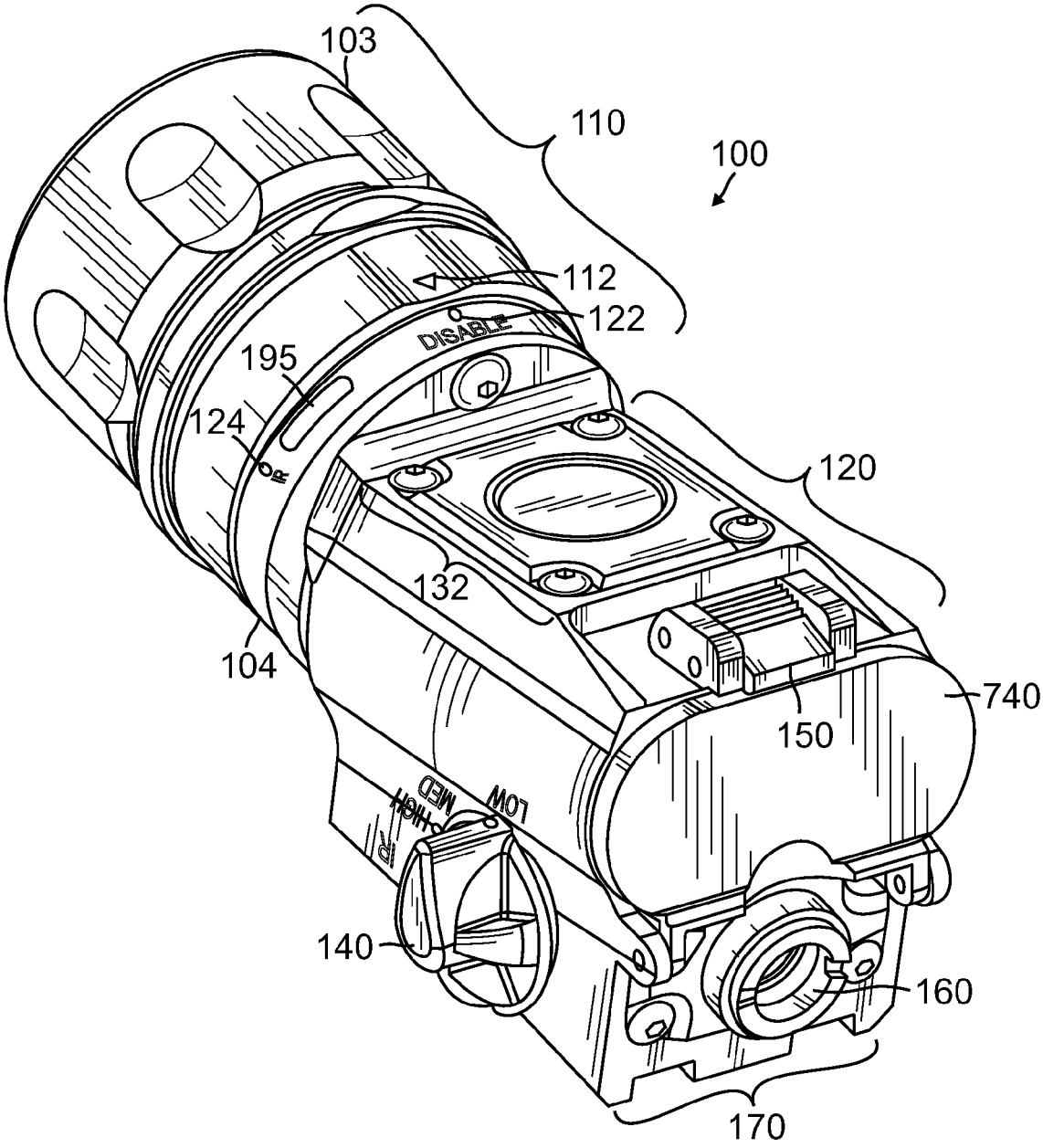
Figure 3C:
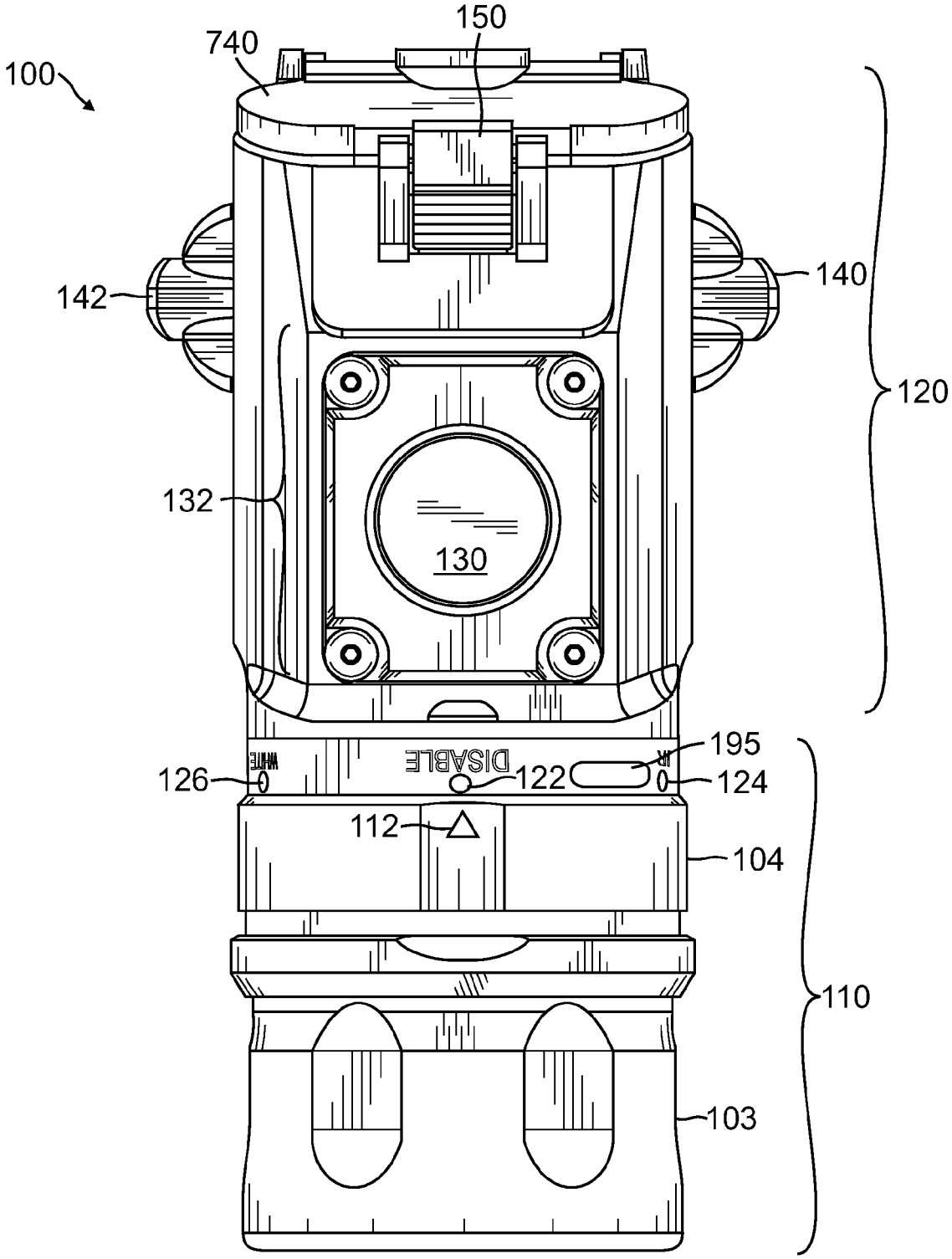
Figure 3D:
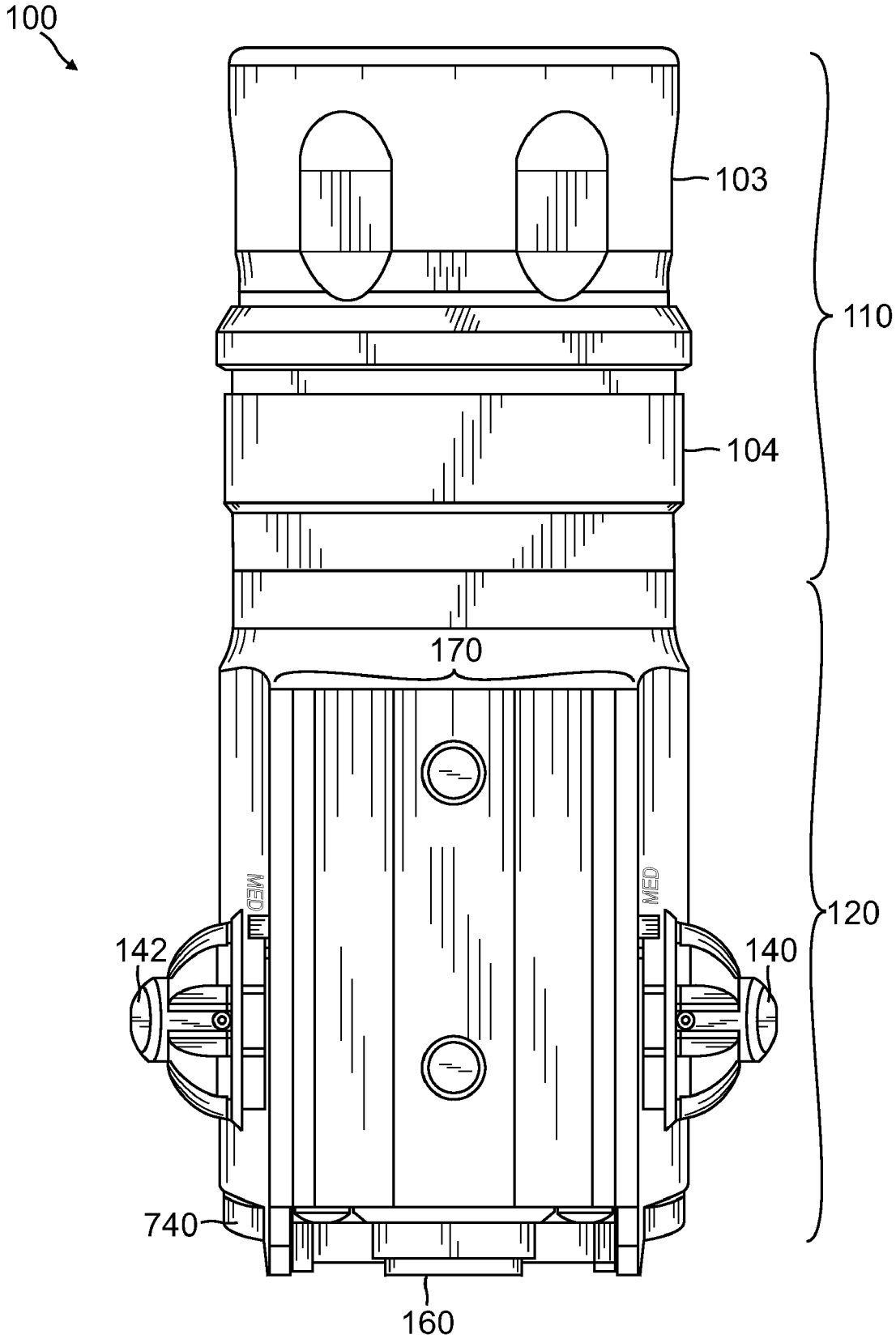
Figure 3E:
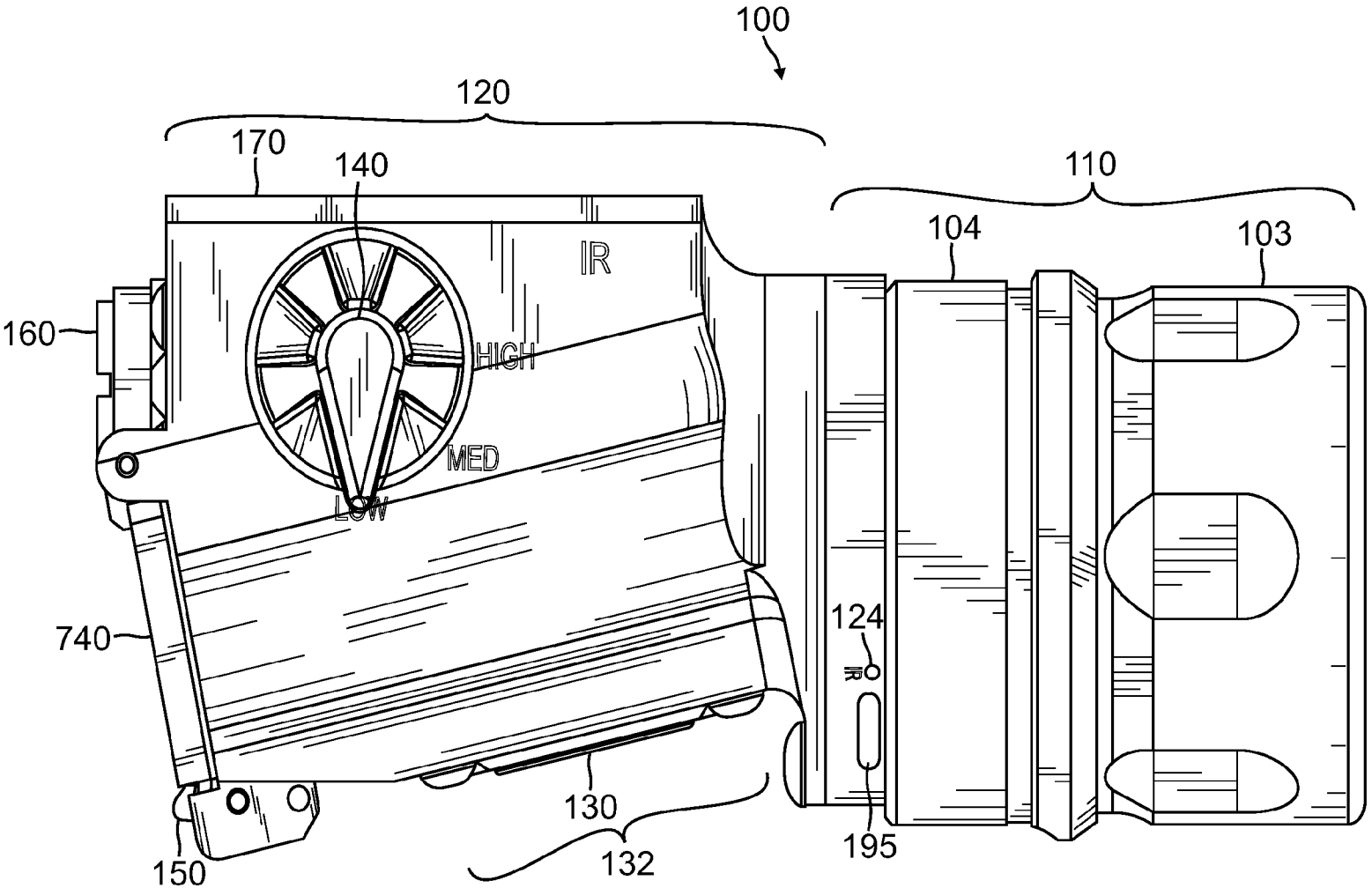
Figure 3F:
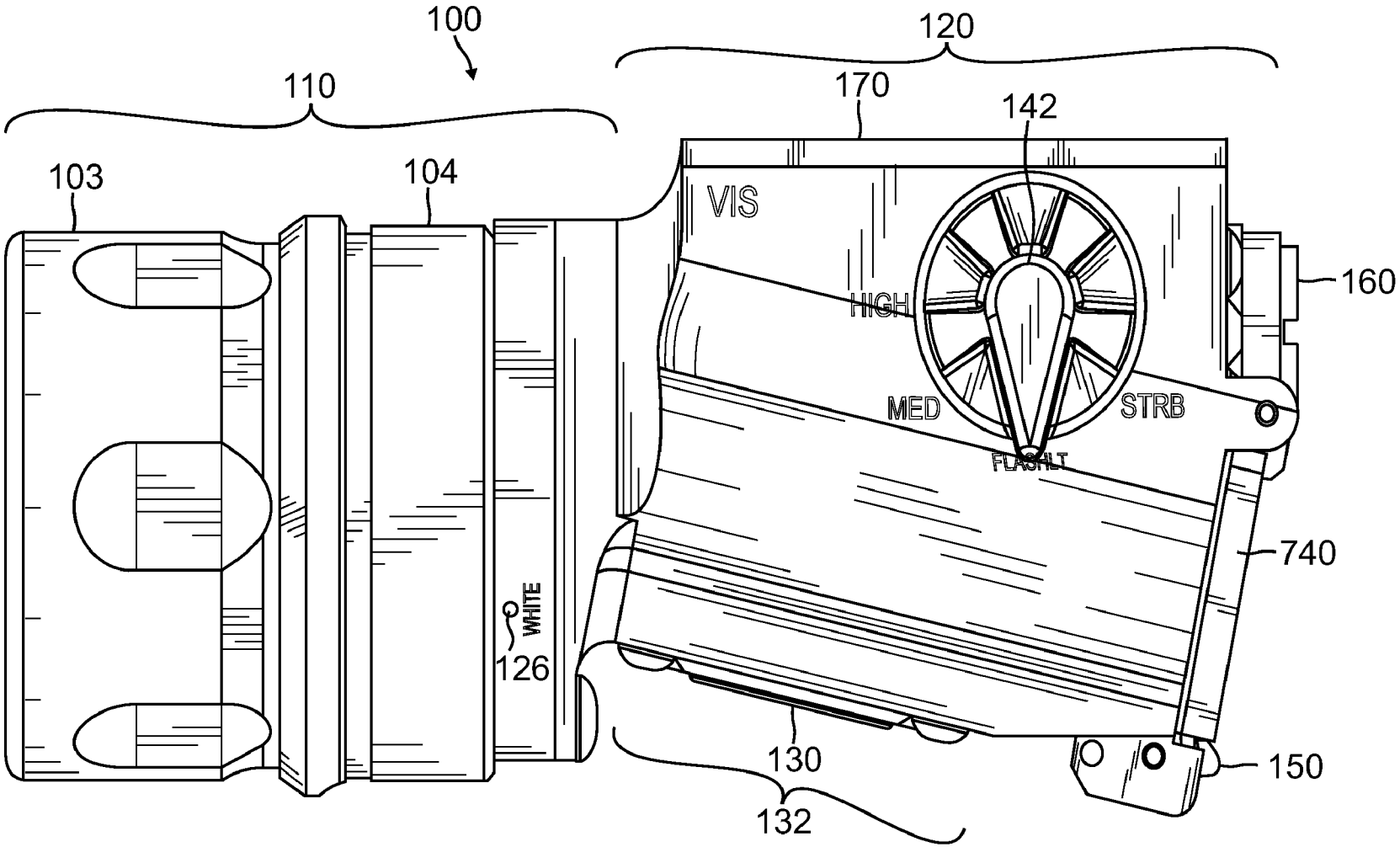
Figure 3G:
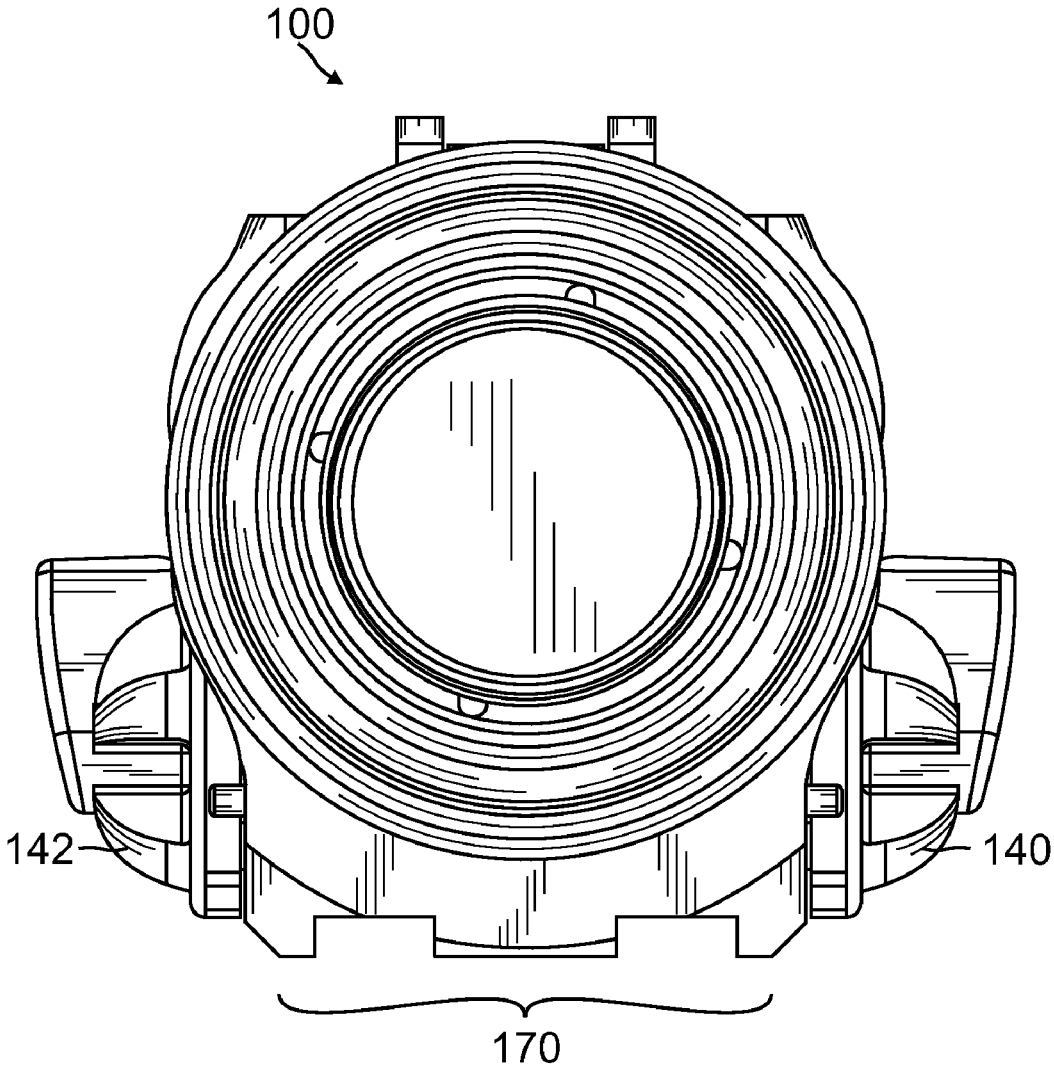
Figure 3H:
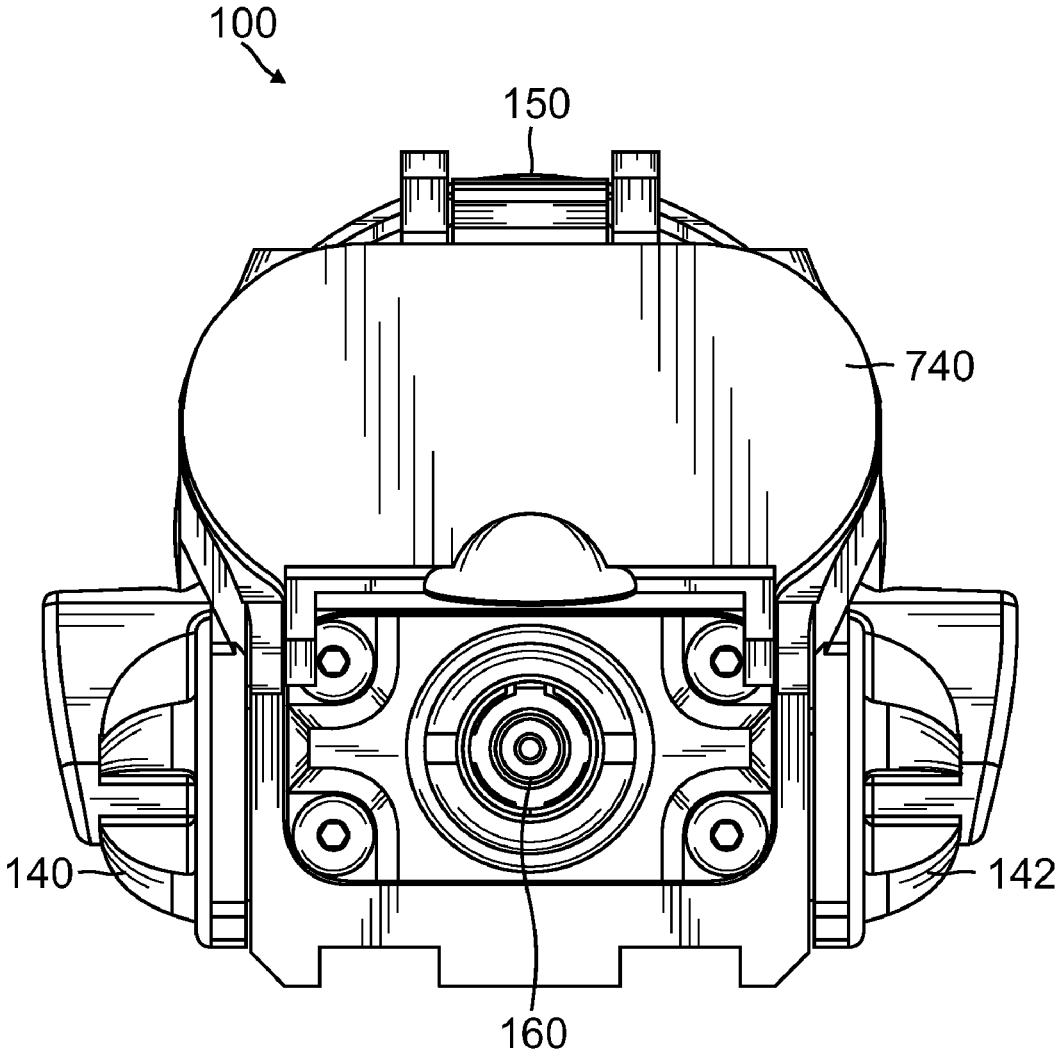

As another example, as shown in FIG. 1B, lighting device 100 may be attached to rail 109 of weapon 101 using a rail clamp mount 102 and further attached to a remote switch 106 in accordance with an embodiment of the invention. Remote switch 106 may be positioned for convenient access by a user of weapon 101 to aid the user in controlling lighting device 100 while the user also operates weapon 101. FIGS. 2A-B provide further views of lighting device 100 connected to remote switch 106 and rail clamp mount 106 in accordance with several embodiments of the invention.

As another example, as shown in FIG. 1C, lighting device 100 may be attached to rail 109 of weapon 101 using a rail clamp mount 102 and further attached to remote switch 106 as discussed above. In accordance with an embodiment of the invention, a vertical grip 108 may also be attached to rail 109 of weapon 101. In this embodiment, vertical grip 108 may provide a convenient resting location for a hand of the user of weapon 101. For example, the user may conveniently actuate remote switch 106 (e.g., by way of the user's thumb or finger) while holding vertical grip 108. In another embodiment, vertical grip 108 may include one or more switches which may be connected to lighting device 100 for controlling lighting device 100.

FIGS. 3A-H illustrate lighting device 100 in accordance with several embodiments of the invention. Lighting device 100 includes a head 110 and a body 120. Head 110 includes a bezel 103 that may rotate relative to body 120 to permit the user to select different wavelengths of light.

One or more lenses (e.g., one or more substantially flat lenses and/or one or more lenses of any other desired shape) and a plurality of light sources may be provided in head 110 to permit different wavelengths of light to be provided by lighting device 100. Although lighting device 100 is primarily described herein as having a lens, other embodiments are also contemplated. For example, in various embodiments, one or more reflectors (e.g., one or more substantially parabolic reflectors and/or one or more reflectors of any other desired shape) may be used in place of, or in addition to, one or more lenses.

Head 110 also includes a lock ring 104 (also referred to as a selector ring) that may be used to lock bezel 103 in any one of several possible positions and may also rotate with bezel 103. In one embodiment, lock ring 104 may be configured such that it locks the bezel 103 in position when lock ring 104 is positioned rearwardly (e.g., toward body 120), and such that it allows the bezel 103 to rotate when lock ring 104 is positioned forwardly (e.g., away from body 120). Thus, to select a desired position of bezel 103 (e.g., to select a desired light source), the user may urge (e.g., push, slide, or otherwise translate) lock ring 104 toward the front of head 110 (e.g., forward or away from body 120), rotate bezel 103 to the desired position, and then urge (e.g., push, slide, or otherwise translate release) lock ring 104 toward the back of head 110 (e.g., rearward or toward body 120) to lock bezel 103 in the desired position. In one embodiment, lock ring 104 may be loaded (e.g., spring loaded by springs 521-523 shown in FIG. 4) such that lock ring 104 remains biased toward body 120 when not urged by the user. As a result, the user may release lock ring 104 after bezel 103 has been rotated to the desired position (e.g., rather than requiring the user to actively urge lock ring 104 toward the back of head 110.

Lock ring 104 includes a marker 112 (e.g., an arrow or any appropriate indicia) which may be used to indicate the position of bezel 103 relative to body 120. In one embodiment, bezel 103 may be rotated to any of three possible positions such that marker 112 is located proximate a position 122, a position 124, or a position 126 of body 120. When bezel 103 is rotated such that marker 112 is located next to position 122 (labeled with an index mark "DISABLE"), light output from lighting device 100 may be disabled. When bezel 103 is rotated such that marker 112 is located next to position 124 (labeled with an index mark "IR"), lighting device 100 may provide infrared light. When bezel 103 is rotated such that marker 112 is located next to position 126 (labeled with an index mark "WHITE"), lighting device 100 may provide white light (e.g., visible white light). In other embodiments, any desired number of positions and any desired types of light (e.g., ultraviolet light or other types) may be provided.

As shown in FIGS. 3A-H, lighting device 100 includes various additional controls. For example, a dome switch 130 may be provided on inclined external surface 132 to control lighting device 100. In several embodiments, dome switch 130 may be used to switch lighting device 100 on and off in accordance with various modes of operation. For example, dome switch 130 may operate with other circuitry (e.g., see FIG. 7) to select a momentary on mode (e.g., in which lighting device 100 provides light while dome switch 130 is held in an on position by the user), a constant on mode (e.g., in which lighting device 100 continues to provide light after dome switch 130 has been twice depressed and released in quick succession by the user), and a flashlight mode (e.g., in which lighting device 100 may be used as a flashlight such as when lighting device 100 is detached from weapon 101).

Lighting device 100 also includes a rotary switch 140 which may be used to select various levels of light output (e.g., low, medium, and high as indicated by the labels "LOW," "MED," and "HIGH") provided by an infrared light source of lighting device 100 (e.g., when head 110 is rotated such that marker 112 of lock ring 104 is proximate position 124).

Lighting device 100 also includes a rotary switch 142 which may be used to select various levels of light output (e.g., flashlight brightness, medium, and high as indicated by the labels "FLASHLT," "MED," and "HIGH") provided by a visible light source of lighting device 100 (e.g., when head 110 is rotated such that marker 112 of lock ring 104 is proximate position 126). Rotary switch 142 may also be used to select a strobe mode of operation (e.g., as indicated by the label "STRB") in which the visible light source of lighting device 100 pulses on and off in a strobe-like fashion.

In one embodiment, rotary switches 140 and 142 may be provided on substantially opposite sides of housing 190. Such an implementation may provide the user with convenient access to both of rotary switches 140 and 142 when operating weapon 101.

Lighting device 100 also includes a latch 150 which may be used to secure a tail cap 740. Lighting device 100 also includes mounting surfaces 170 which may engage with rail clamp mount 102 to connect lighting device 100 to remote switch 106 the manner shown in FIGS. 2A-B.

Lighting device 100 also includes a connector 160 configured to receive remote switch 106 to connect remote switch 106 or other switches (e.g., a switch provided by vertical grip 108 or otherwise) to lighting device 100 in the manner shown in FIGS. 2A-B. In several embodiments, connector 160 may be implemented to be compatible with switches described in U.S. Pat. Nos. 7,273,292 and 7,441,918 which are both hereby incorporated by reference herein in their entirety. In other embodiments, other connectors may be used as appropriate.

Lighting device 100 may also include an indicator button 195 (e.g., a physical tactile surface). In one embodiment, indicator button 195 may be an infrared indicator button which provides tactile feedback to the user to indicate that lighting device 100 has been configured to provide infrared light without requiring the user to visually check the position of lock ring 104 or activate lighting device 100. In other embodiments, indicator button 195 may be used to indicate any desired configuration of lighting device 100.

Figure 4:
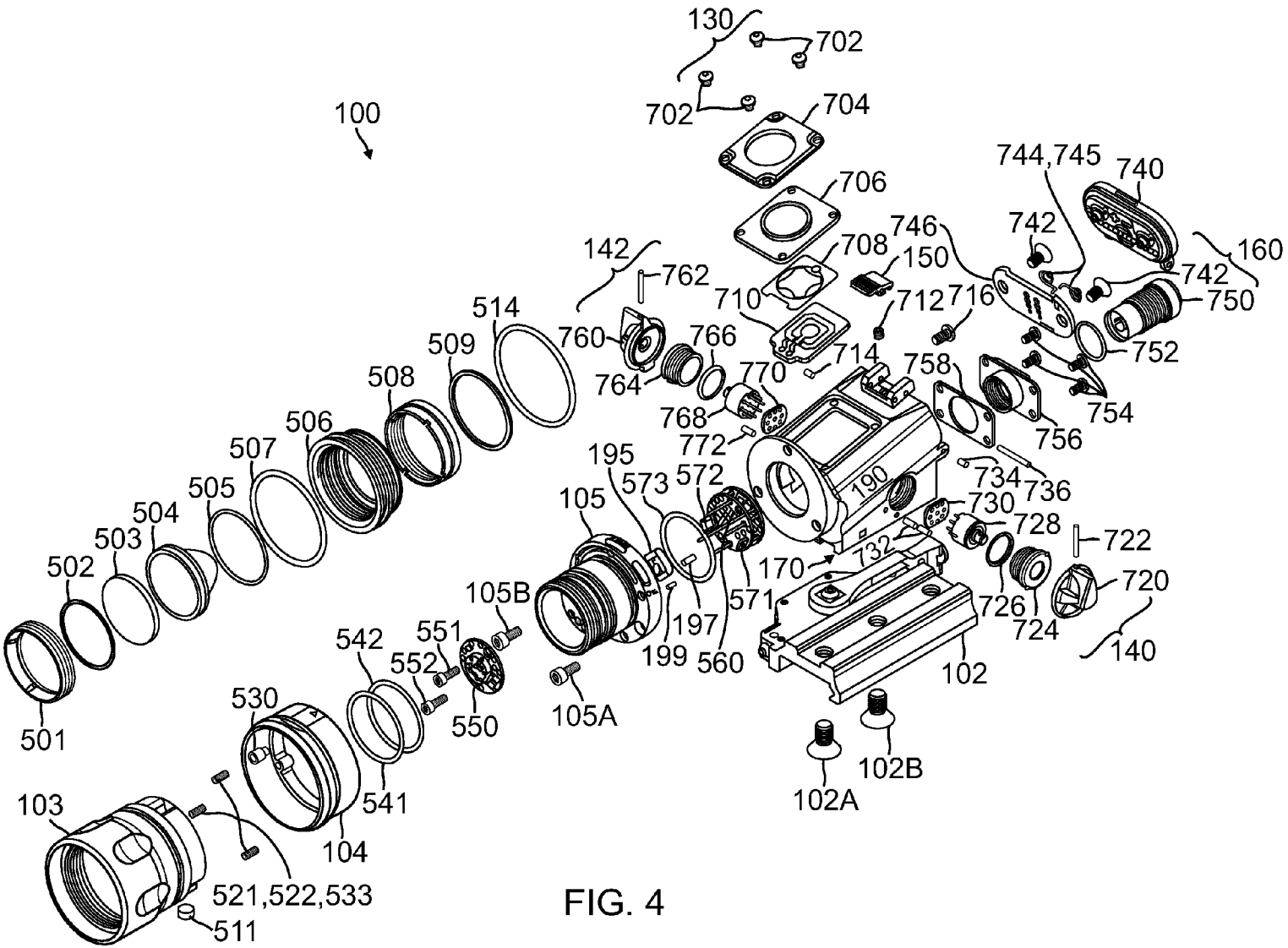
FIG. 4 illustrates an exploded view of a lighting device in accordance with an embodiment of the invention.

FIG. 4 illustrates an exploded view of lighting device 100 in accordance with an embodiment of the invention. FIG. 4 further illustrates rail clamp mount 102 which may be secured to mounting surfaces 170 by screws 102A and 102B.

As shown in FIG. 4, a lens retainer 501 may secure a planar lens 503 and a total internal reflection (TIR) lens 504 into a TIR housing 506. A flat gasket 502 may be disposed between lens retainer 501 and planar lens 503. An o-ring 505 may be disposed between the TIR lens 504 and the TIR housing 506. Lens retainer 501 may be threaded into TIR housing 506 so as to capture flat gasket 502, planar lens 503, TIR lens 504, and o-ring 505 between lens retainer 501 and TIR housing 506.

In one embodiment, planar lens 503 may be a substantially a flat (e.g., plano-plano) lens. It is contemplated that planar lens 503 may be implemented in accordance with any desired type of lens in other embodiments. In one embodiment, TIR lens 504 may be implemented as a solid optical element that uses total internal reflection to direct light from a selected light source (e.g., an LED or other light source) to planar lens 503. Planar lens 503 and TIR lens 504 may be formed of glass, plastic, or any other desired material that is substantially transparent at the wavelengths of light produced by the light sources. Indeed, any desired combination of material and types of lenses may be used.

TIR housing 506 may thread into the bezel 103. An o-ring 507 may be captured between TIR housing 506 and bezel 103. Bezel 103 may include a magnet 511 that is disposed within an opening 512 (see FIG. 5A) of bezel 103.

In an embodiment implemented with two light sources, bezel 103 may be used to select one light source at one extreme of its rotation and may be used to select another light source at the other extreme of its rotation. In one embodiment, bezel 103 may be rotated a maximum of approximately 135 degrees.

A bezel retainer 508 may thread onto heat sink 105 so as to capture and retain bezel 103 upon heat sink 105. A flat gasket 509 may be disposed between bezel retainer 508 and heat sink 105. Bezel 103 may have a bore (such as bore 651 of FIG. 5A) that is off center or eccentric with respect to a centerline 600 of head 110 (see FIG. 5A). Thus, rotation of bezel 103 may result in off center or eccentric rotation of bezel 103, as well as of components attached to bezel 103, such as TIR lens 504.

An o-ring 514 may be captured between bezel 103 and lock ring 104. A plurality of springs (e.g., three springs 521-523) may bear upon lock ring 104 and bezel 103 in a manner that tends to urge lock ring 104 away from the bezel 103 (e.g., rearwardly) and that thus tends to maintain lock ring 104 in the locked position thereof. That is, springs 521-523 may bias lock ring 104 toward body 120.

Spring 521-523 may be received within a detent 530. Detent 530 may be received within one of a plurality of holes, such as a hole 531 (see FIG. 5A), to lock bezel 103 into position with respect to heat sink 105. In one embodiment, the number of such holes may conform to the number of positions in which it is desired for bezel 103 to lock into position. In one embodiment, the number of such positions of bezel 103 may conform to the number of different light sources of lighting device 100 that may be selected by the user. In one embodiment, one of the holes, such as hole 531, may be used to lock bezel 103 into a position in which marker 112 is proximate position 124 for selecting an infrared light source, and another one of the holes may be used to lock bezel 103 into a position in which marker 112 is proximate position 126 for selecting a white light source. The holes may be spaced apart by any desired distance. Thus, the distance or angle through which bezel 103 is rotated to select different light sources may be any desired distance or angle.

Lock ring 104 may slide over and be slidably disposed upon bezel 103. In turn, bezel 103 may slide over and be rotatably disposed upon heat sink 105. Two o-rings 541 and 542 may be disposed upon heat sink 105, between bezel 103 and heat sink 105. O-rings 541 and 542 may provide a bearing surface that facilitates rotation of bezel 103 with respect to heat sink 105.

Heat sink 105 may receive and mount a light source printed circuit board (PCB) 550. Light source PCB 550 may be attached to heat sink 105 via screws 551 and 552. PCB 550 may include one or more light sources (e.g., LEDs and/or other types of light sources) attached thereto. In one embodiment, such LEDs may be implemented using one or more dies (e.g., multiple die LEDs). In one embodiment, one or more white light LEDs and one or more infrared LEDs may be attached to light source PCB 550. Heat sink 105 may operate as a heat sink for light sources that are attached to light source PCB 550. Thus, heat sink 105 may dissipate heat from the light sources to other parts of lighting device 100 and to ambient air. As also shown in FIG. 4, an o-ring 573 may be disposed between heat sink 105 and housing 190. Heat sink may also include indicator button 195, a pin 197, and a spring 199 further described herein A control PCB 560 may be received within heat sink 105, such as within the end thereof that attaches to housing 190 by screws 105A, 105B, and 716. In one embodiment, control PCB 560 may be implemented using two stacked PCBs as shown in FIG. 4. Light source PCB 550 and/or control PCB 560 may be electrically connected to one or more batteries provided within a cavity 151 (see FIG. 5A) of housing 190.

Control PCB 560 may include circuitry to determine which, if any, of the light sources are to be illuminated, and also to illuminate the selected light source. Thus, control PCB 560 may receive electric power from one or more batteries and provide electric power to the selected light source. In one embodiment, heat sink 105 may make electrical contact with housing 190 which may be electrically connected to a terminal of one or more batteries to provide an electrical connection. One or more additional electrical connections may be implemented using appropriate springs, wires, or other techniques which will be appreciated by those skilled in the art.

More particularly, one or more Hall effect sensors may be attached to control PCB 560 to sense the current position of bezel 103. For example, two Hall effect sensors 571 and 572 may be attached to control PCB 560 to sense the position of magnet 511 that is attached to the bezel 103. In this manner, the position to which bezel 103 has been rotated may be sensed to determine which light source is to be illuminated by control PCB 560.

As shown in FIG. 4, dome switch 130 may be assembled using screws 702, a switch plate 704, a button pad 706, a switch 708, and a switch PCB 710.

As also shown in FIG. 4, rotary switches 140/142 may be assembled using knobs 720/760, dowel pins 722/762, caps 724/764, gaskets 726/766, switches 728/768 (e.g., switches permitting approximately 135 degree rotation in one embodiment), switch PCBs 730/770, and pins 732/772.

As also shown in FIG. 4, connector 160 may be assembled using a receptacle 750, an o-ring 752, screws 754, a connector plate 756, and a gasket 758. Connector 160 may interface with control PCB through appropriate electrical connections as will be appreciated by those skilled in the art.

Lighting device 100 may further include latch 150, a spring 712 (e.g., for spring loading latch 150), a pin 714, pins 734/736, tail cap 740, and screws 742. In addition, lighting device 100 may further include battery contact springs 744/745 and battery contact PCB 746, all of which may be used to provide appropriate electrical connections between one or more batteries, light source PCB 550, and/or control PCB 572.

In one embodiment, the structural components of lighting device 100 may be formed of a metal, such as aluminum, magnesium, or steel. In another embodiment, these structural components may be formed of a durable plastic, such a polycarbonate or acrylonitrile butadiene styrene (ABS), or any other material as desired. In another embodiment, the structural components proximate magnet 511 (e.g., bezel 103 and heat sink 105) may be formed of a non-ferrous material such that sensing of magnet 511 by Hall effect sensors 571 and 572 is not substantially inhibited thereby.

Figure 5A:
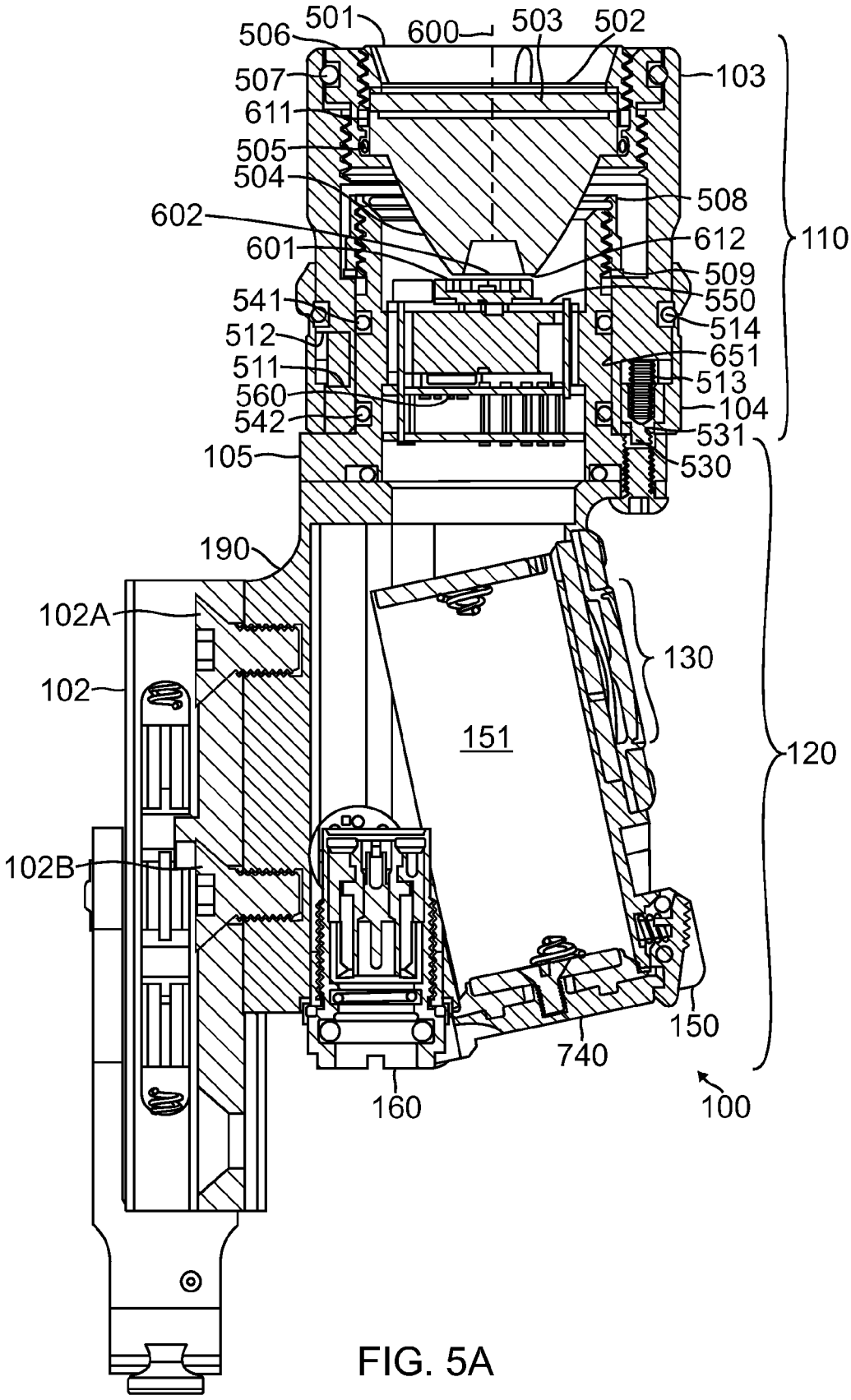
FIG. 5A illustrates a cross-sectional side view of a lighting device attached to a rail clamp mount in accordance with an embodiment of the invention.

FIG. 5A illustrates a cross-sectional side view of lighting device 100 attached to rail clamp mount 102 in accordance with an embodiment of the invention. As shown in FIG. 5A, a light source assembly 601 may include a plurality of light sources that are attached to light source PCB 550. Light source assembly 601 may include one or more white light sources, one or more infrared light sources LEDs, one or more ultraviolet light sources, and/or other types of light sources. In one embodiment, light source assembly 601 may include a plurality of white light LEDs that are grouped together, and may further include a plurality of infrared light LEDs that are grouped together.

In one embodiment, light source assembly 601 may be configured such that none of the light sources are on centerline 600 of head 110. Thus, a white light source and an infrared light source may both be off center with respect to centerline 600. In one embodiment, the white light source and the infrared light source may both be off center with respect to centerline 600 by the same amount and may both be disposed upon an arc defined by movement of a bottom end 612 of TIR lens 504, as discussed in detail below.

Light source assembly 601 may similarly include other light sources or groups of light sources. For example, in one embodiment, light source assembly 601 may include a group of red light sources, a group of green light sources, and/or a group of blue light sources. Light source assembly 601 may include any desired number of groups of light sources and each group of light sources may include any desired number and/or combination of light sources. Accordingly, discussion herein of white light sources and infrared light sources is by way of example only, and not by way of limitation.

TIR lens 504 may be generally conical in configuration. TIR lens 504 may have a top end 611 (e.g., a larger end) that is proximate planar lens 503 and may have a bottom end 612 (e.g., a smaller end) that is proximate light source assembly 601. Top end 611 and bottom end 612 of TIR lens 504 may be eccentric with respect centerline 600 of head 110. Thus, rotation of head 110 may cause TIR lens 504, and in particular bottom end 612 of TIR lens 504, to move in an arc. The light sources of light source assembly 601 may be disposed along this arc such that rotation of TIR lens 504 moves bottom end 612 thereof from one light source to another light source.

TIR lens 504, and more particularly bottom end 612 thereof, may be made to be eccentric or offset with respect to centerline 600 of head 110 by forming a bore 651 of bezel 103 to be eccentric with respect to centerline 600 of head 110. Thus, as bezel 103 is rotated with respect to light source assembly 601, TIR lens 504 moves in an arc, as described above.

Bottom end 612 may include a light inlet 602 that is configured to receive light from light source assembly 601 into TIR lens 504. Bottom end 612, and more particularly light inlet 602, may move from one light source to another light source as bezel 103 is rotated.

Thus, rotation of TIR lens 504 may be caused by rotation of bezel 103 to which TIR lens 504 is attached. Such movement may move inlet 602 from being positioned proximate one light source of light source assembly 601 to being positioned proximate another light source of LED assembly 601. Thus, rotation of bezel 103 may be used to select which light source of light source assembly 601 provides light to TIR lens 504. For example, when light inlet 602 is positioned proximate a white light source that is turned on, then white light from the white light source enters TIR lens 504 and lighting device 100 provides white light. Similarly, when the light inlet 602 is positioned proximate an infrared light source that is turned on, then infrared light from the infrared light source enters TIR lens 504 and lighting device 100 provides infrared light. Thus, TIR lens 504 is movable between light sources and the position of inlet 602 determines from which light source TIR lens 504 receives light.

Embodiments may be configured to facilitate locking of bezel 103 in a desired position. For example, bezel 103 may be locked in a position for the desired light, (e.g., white or infrared) to be provided by lighting device 100. Lock ring 104 may be configured such that when lock ring 104 is positioned toward the bottom of head 110, then bezel 103 is locked in position and rotation thereof is inhibited. Conversely, lock ring 104 may be configured such that when lock ring 104 is positioned toward the top of head 110, then bezel 103 is not locked in position, such that rotation thereof is facilitated. Springs 521-523 may bias lock ring 104 in position toward the bottom of head 110 such that bezel 103 is locked unless the user moves the lock ring 104 toward the top of the head 110.

Lock ring 104 may interface with bezel 103 such that bezel 103 may only rotate if lock ring 104 may rotate. For example, lock ring 104 may interface with bezel 103 via a plurality of splines. When lock ring 104 is moved toward the top of head 110, then detent 530 may be pulled by lock ring 104 from opening 531 of heat sink 105 within which detent 530 is seated. When detent 530 is seated within opening 531, bezel 103 is locked in position and rotation is inhibited. When detent 530 is pulled from opening 531, bezel 103 is not locked in position and rotation is facilitated.

In certain embodiments, lighting device 110 may be configured so as to provide electric power only to selected light sources. For example, electric power may be provided only to the light source that provides light to TIR lens 504. Rotation of bezel 103 may determine which light source is provided electric power.

Figure 5B:
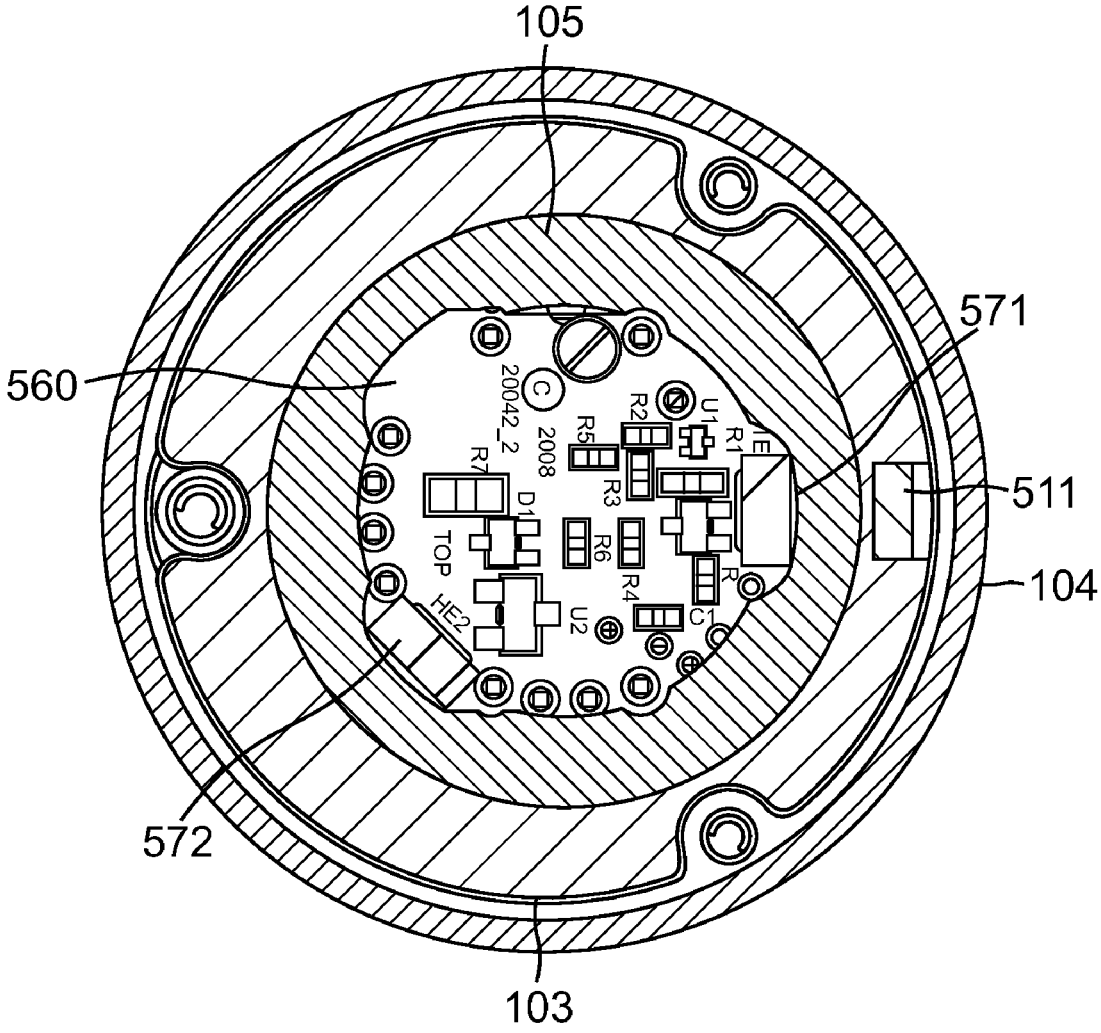
FIG. 5B illustrates a cross-sectional top view of a head of a lighting device in accordance with an embodiment of the invention.

FIG. 5B illustrates a cross-sectional top view of head 110 of lighting device 100 in accordance with an embodiment of the invention. As shown in FIG. 5B, one or more Hall effect sensors may cooperate with one or more magnets to sense rotation of bezel 103 and thus to facilitate selection of the desired light source that is to be provided electrical power and thus illuminated. For example, Hall effect sensors 571 and 572 (which are attached to control PCB 560) may be fixed with respect to heat sink 105. Magnet 511 (which is attached to bezel 103) rotates with bezel 103. Thus, rotation of bezel 103 may move magnet 511 from proximate one Hall effect sensor 571 or 572 to proximate the other Hall effect sensor 572 or 571. Each Hall effect sensor 571 and 572 may sense the presence of magnet 511, thus facilitating the use of rotation of bezel 103 to select which light source receives electric power.

In various embodiments, any desired combination of control of electrical power and alignment of TIR lens 504 with a light source may be provided by rotation of bezel 103. Thus, for example, rotation of bezel 103 may both align TIR lens 504 with the light source that provides the desired output (e.g., white light or infrared light), and may facilitate the application of electric power to the same light source.

Figure 6B:
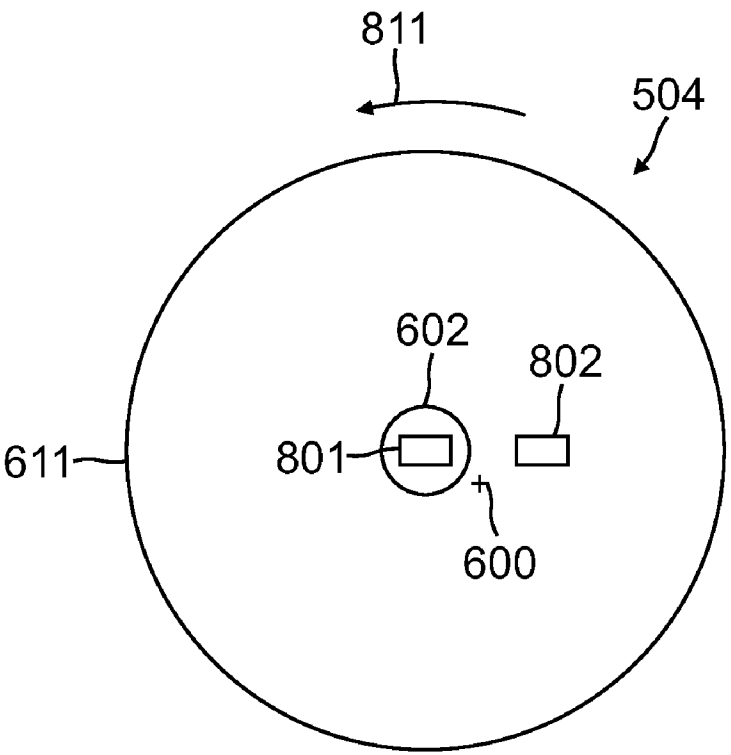
FIGS. 6A-B illustrate relative positions of a light inlet and light sources when a bezel of a lighting device is rotated in different positions in accordance with several embodiments of the invention.
Figure 6A:
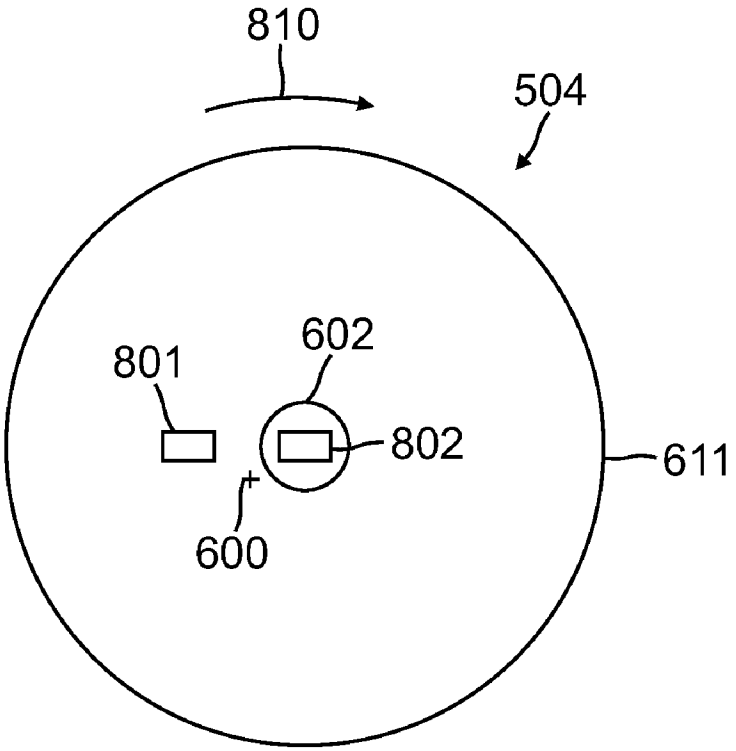

FIGS. 6A-B illustrate relative positions of light inlet 602 and light sources 801 and 802 when bezel 103 is rotated in different positions in accordance with several embodiments of the invention. In particular, FIGS. 6A-B are top views that show schematically how rotation of TIR lens 504 (such as rotation caused by rotation of bezel 103) facilitates the selection of one of two different light sources 801 and 802. In FIGS. 6A-B, light source 801 is a white light LED and light source 802 is an infrared LED.

The eccentricity of TIR lens 504 has been exaggerated in FIGS. 6A-B, so as to more clearly show how such eccentricity facilitates the selection of the desired light source. As discussed herein, any desired number of such light sources may be selected from in this manner. For example, two, three, four, or more LEDs may be selected from in this manner.

FIG. 6A shows TIR lens 504 after being rotated in the direction of an arrow 810 such that light inlet 602 thereof is proximate (e.g., above) infrared LED 802. FIG. 6B shows TIR lens 504 after being rotated in the direction of an arrow 811 which results in movement of light inlet 602 from the infrared LED 802 to the white light LED 801.

TIR lens 504 is offset or eccentric with respect to centerline 600 of head 110 such that the position of TIR lens 504 changes substantially between FIGS. 6A and 6B. More particularly, bottom end 612 and light inlet 602 of TIR lens 504 change positions substantially between FIGS. 6A and 6B. This change in position occurs because TIR lens 504 is substantially eccentric with respect to centerline 600 and rotates about centerline 600.

Figure 7:
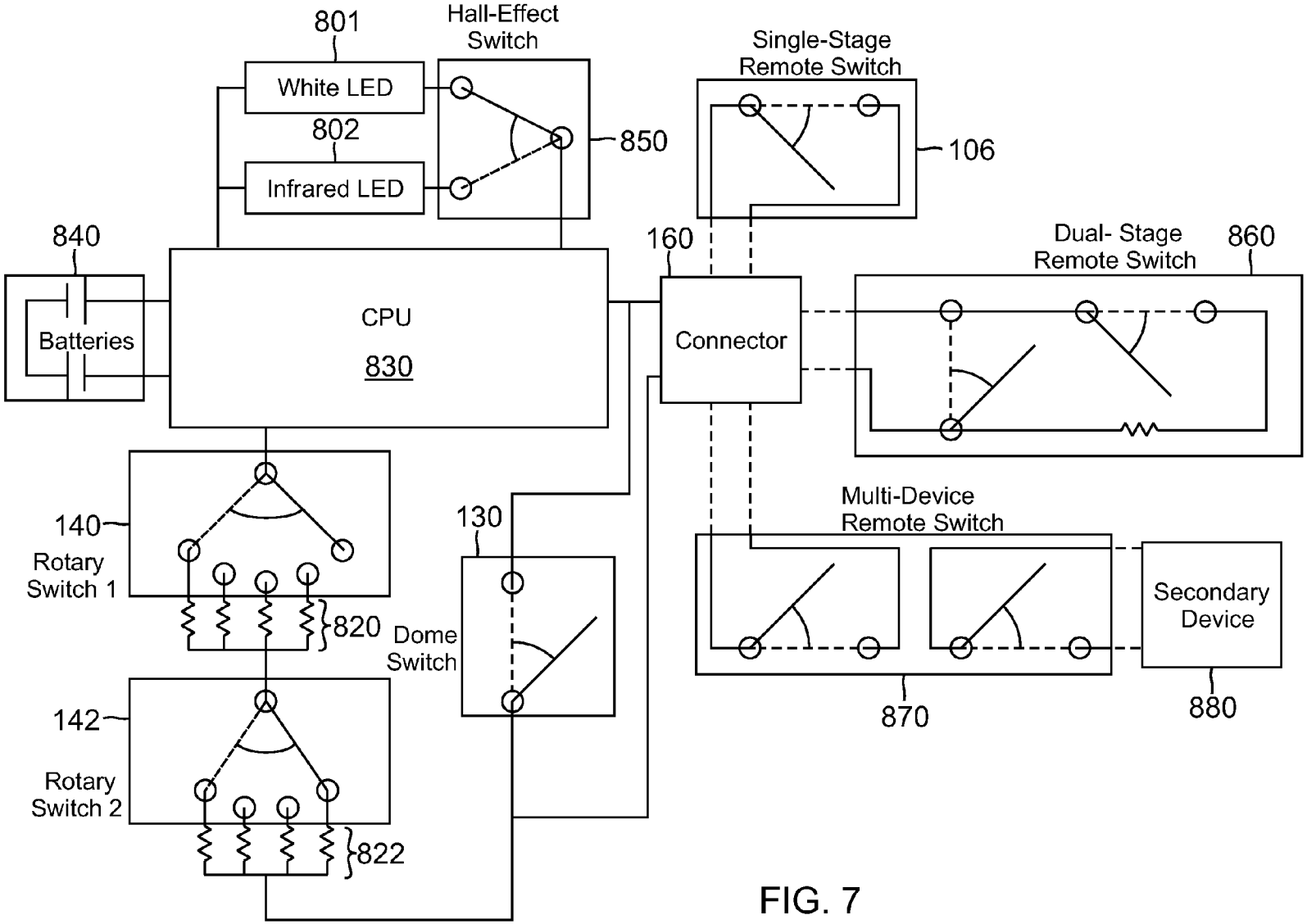
FIG. 7 illustrates an electrical schematic of a lighting device in accordance with an embodiment of the invention.

FIG. 7 illustrates an electrical schematic of lighting device 100 in accordance with an embodiment of the invention. A microprocessor 830 (labeled CPU) may be provided on control PCB 560 and powered by one or more batteries 840 (e.g., which may be provided in cavity 151). Microprocessor 830 may receive input signals (e.g., control signals) from rotary switches 140 and 142 (each of which is connected to an associated group of resistors 820 and 822 as shown in FIG. 7)

and dome switch 130. Microprocessor 830 may also receive input signals from one or more switches attached to connector 160. For example, remote switch 106 and/or vertical grip 108 may be implemented as a single stage remote switch attached to connector 160. Other switches such as a dual stage remote switch 860, a multiple device remote switch 870 (e.g., a switch that permits one or more additional secondary devices 880 to be connected therethrough), or other types of switches may be used. Microprocessor 830 may also receive input signals from a Hall effect switch 850 implemented, for example, using Hall effect sensors 571 and 572. In response to the various received signals, microprocessor 830 may selectively operate LEDs 801 and 802 switch on, switch off, operate in a strobe-like manner, and/or provide various brightness levels.

Figure 8A:
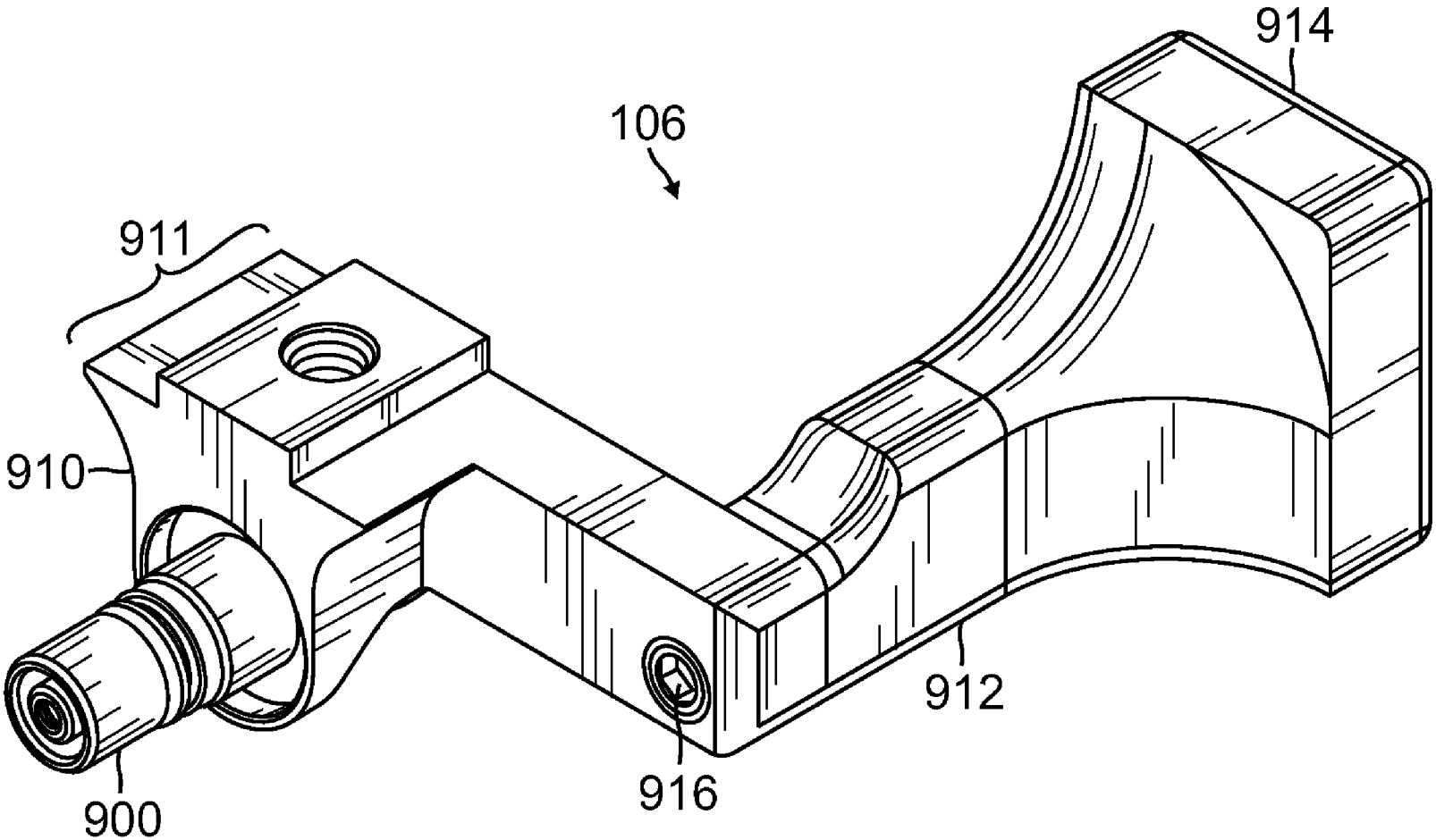
FIGS. 8A-B illustrate a remote switch which may be connected to a lighting device in accordance with several embodiments of the invention.
Figure 8B:
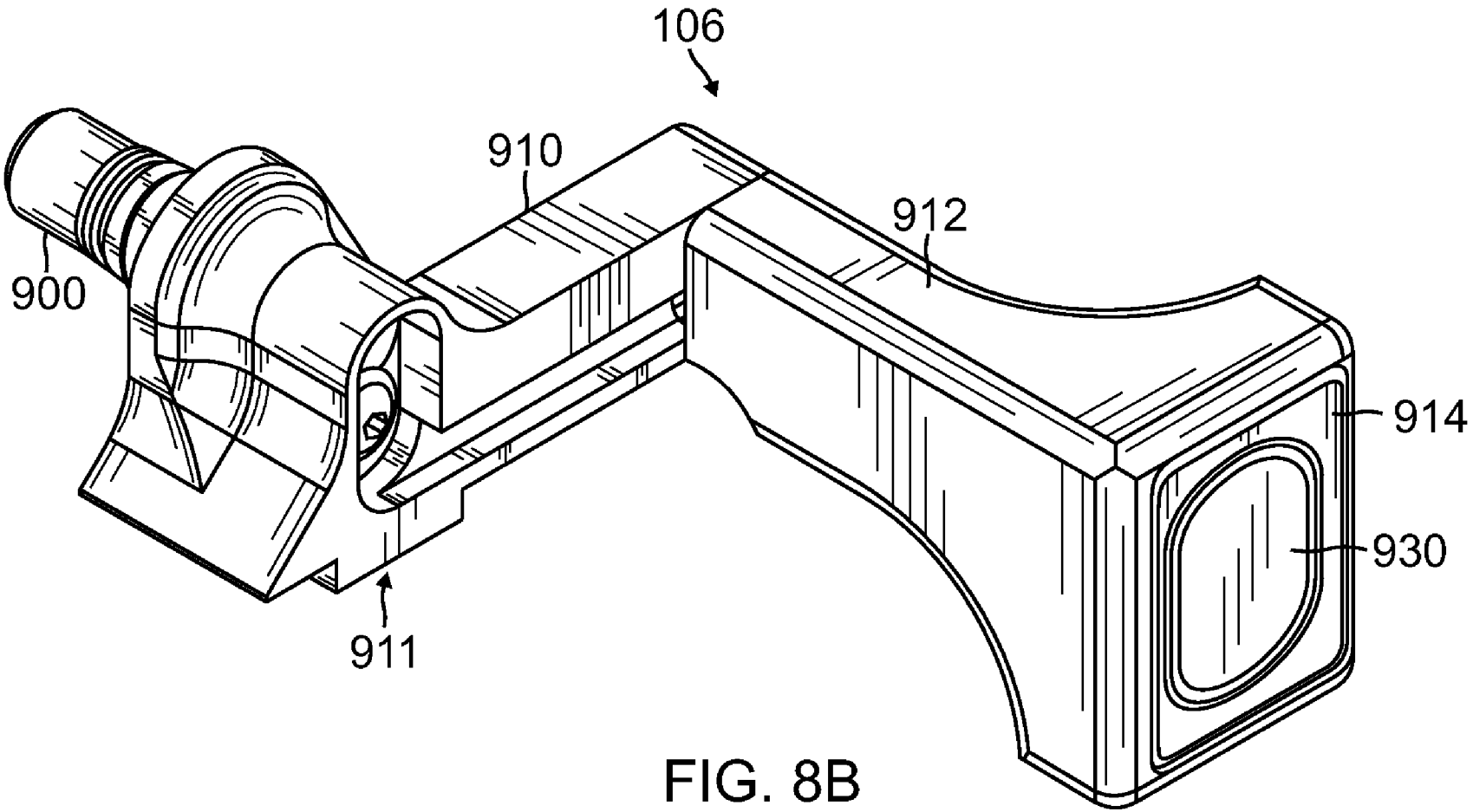
Figure 8C:
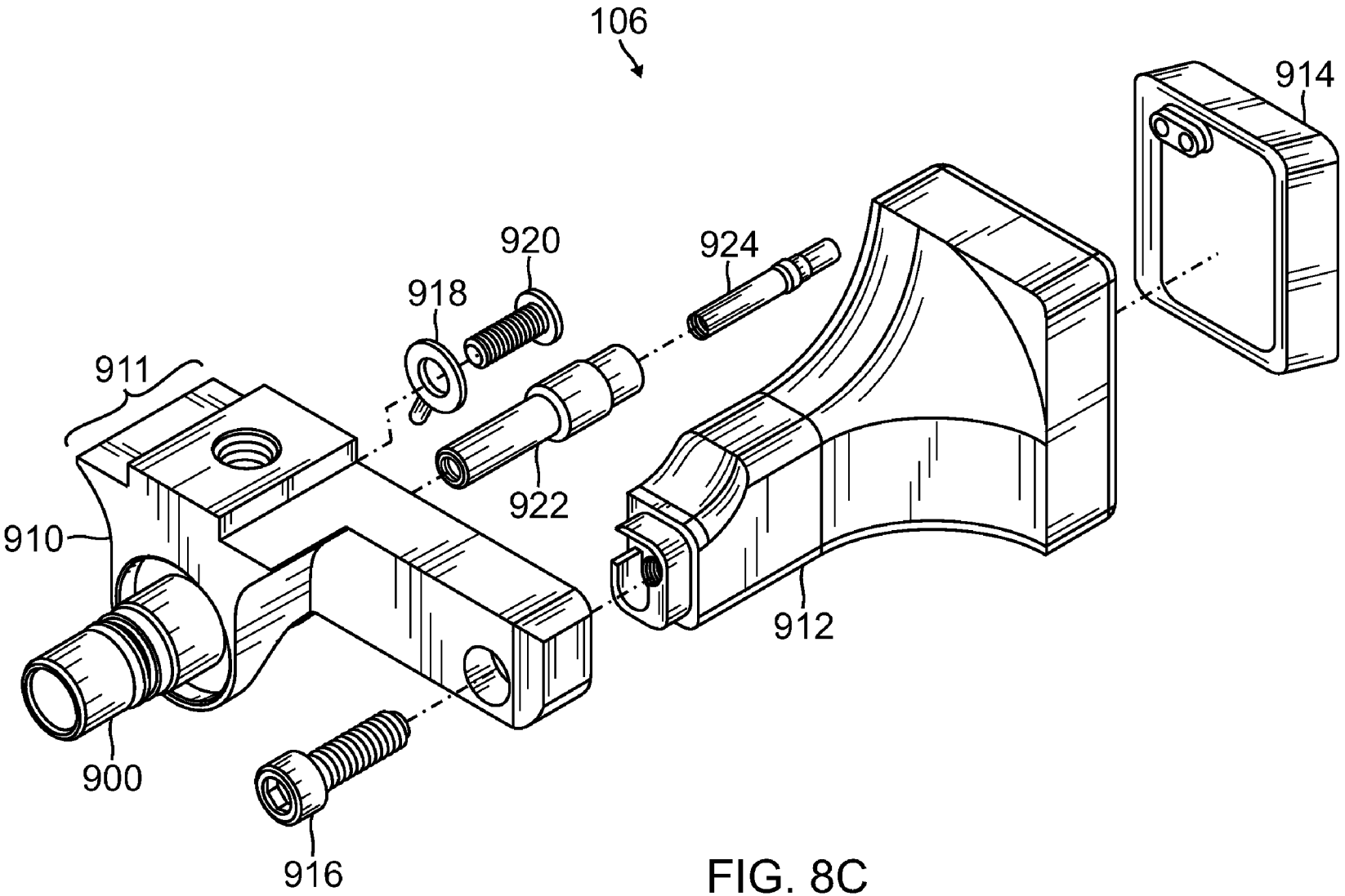
FIG. 8C illustrates an exploded view of a remote switch which may be connected to a lighting device in accordance with an embodiment of the invention.

FIGS. 8A-C illustrate remote switch 106 which may be connected to lighting device 100 in accordance with several embodiments of the invention. In particular, FIGS. 8A-B illustrate remote switch 106 when assembled and FIG. 8C illustrates an exploded view of remote switch 106.

Remote switch 106 includes a connector body 910 having a protrusion 900 for insertion into connector 160 of lighting device 100. A top surface 911 of connector body 910 may engage with rail clamp mount 102 to mount remote switch 106 as shown in FIGS. 1B-C and 2A-B. Remote switch 106 also includes a housing 912 which may be connected to connector body 910 by a screw 916. Remote switch 106 also includes a ring terminal 918, screw 920, insulator 922, and socket contact 924.

Remote switch 106 also includes a rear member 914 which may engage with housing 912. As shown in FIG. 8B, rear member 914 includes a surface 930 which may be pushed by the user to operate remote switch 106. Accordingly, the user may provide signals to microprocessor 830 to operate lighting device 100 in a conveniently manner while lighting device 100 is positioned remotely from the user (e.g., near a front end of a weapon or other locations).

Figure 9A:
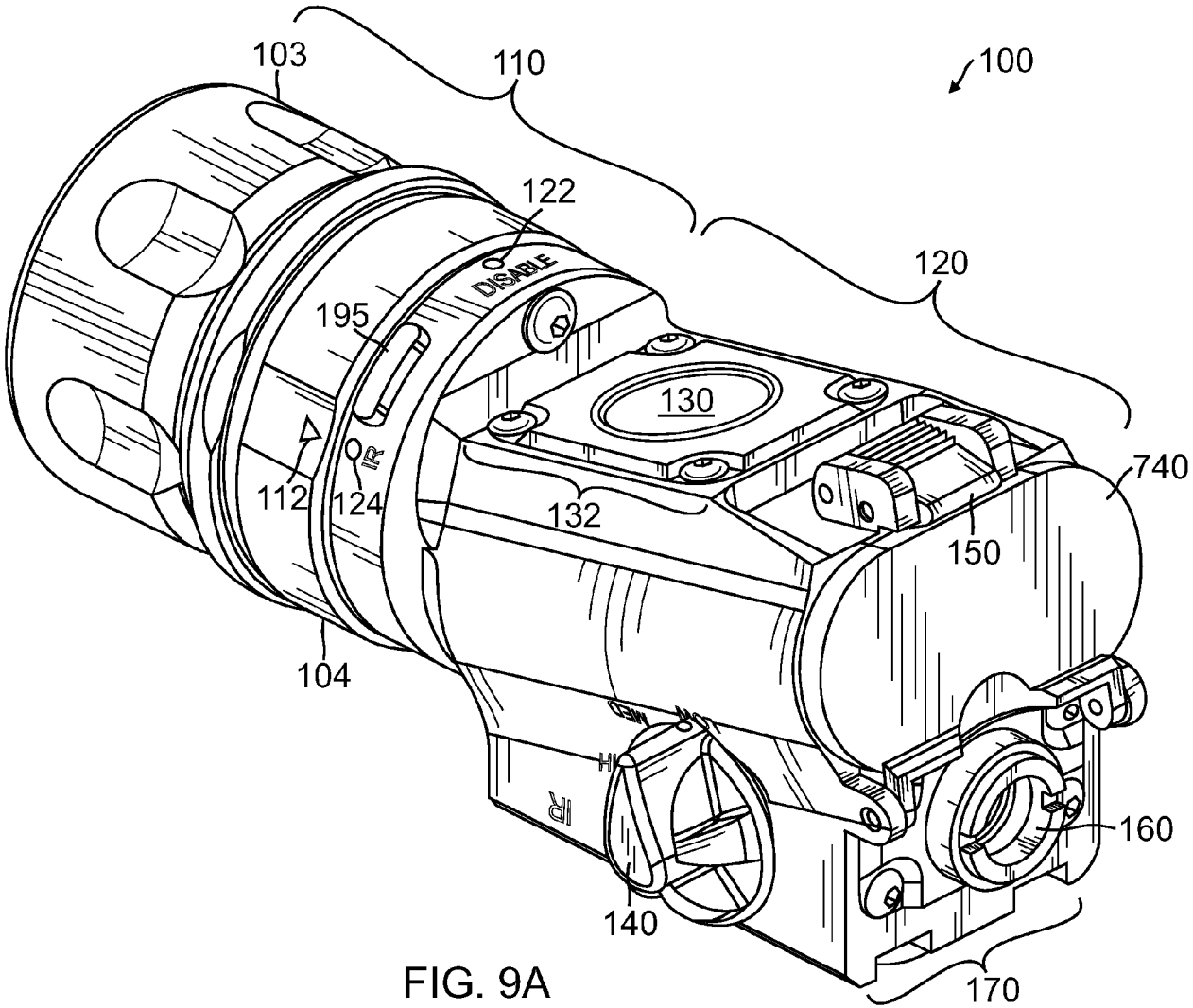
FIG. 9A illustrates a lighting device with an indicator button in an expanded position in accordance with an embodiment of the invention.
Figure 9B:
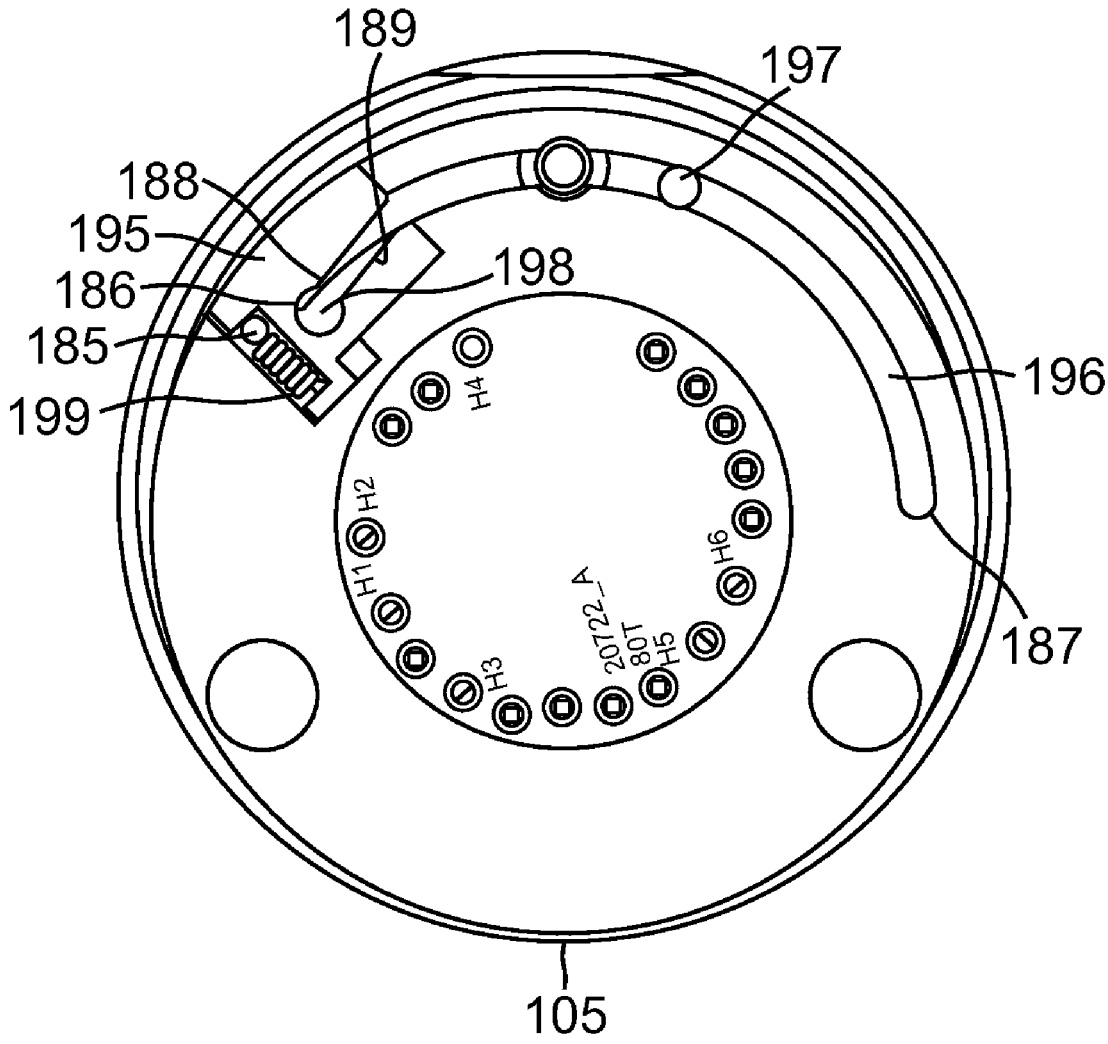
FIG. 9B illustrates a cross-sectional top view of a heat sink of a lighting device with an indicator button in a retracted position in accordance with an embodiment of the invention.
Figure 9C:
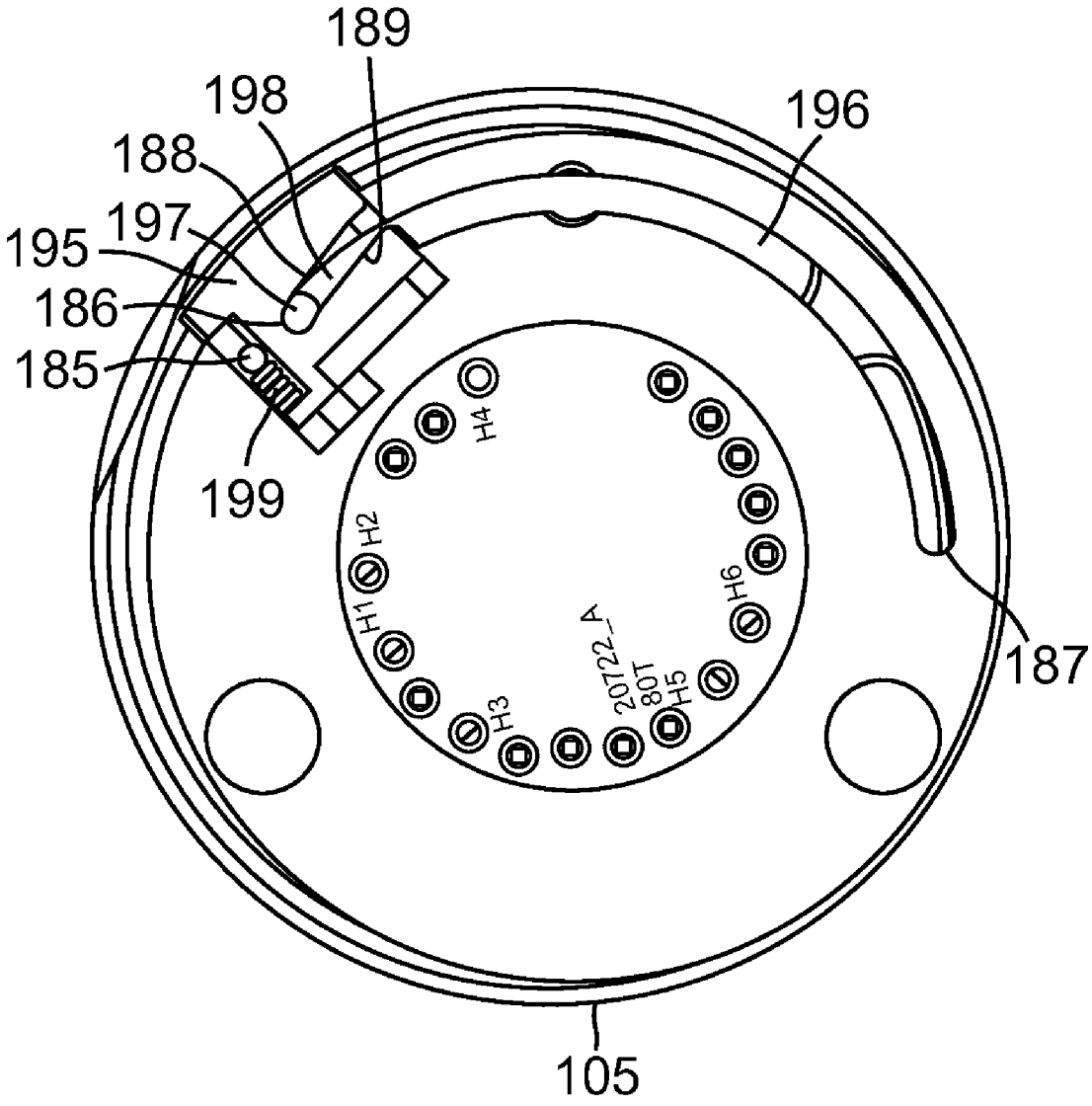
FIG. 9C illustrates a cross-sectional top view of a heat sink of a lighting device with an indicator button in an expanded position in accordance with an embodiment of the invention.

FIG. 9A illustrates a lighting device with an indicator button in an expanded position in accordance with an embodiment of the invention. FIG. 9B illustrates a cross-sectional top view of a heat sink of a lighting device with an indicator button in a retracted position in accordance with an embodiment of the invention. FIG. 9C illustrates a cross-sectional top view of a heat sink of a lighting device with an indicator button in an expanded position in accordance with an embodiment of the invention.

Lighting device 100 may include an indicator button 195 which may be selectively expanded out from head 110 or retracted into head 110 in response to the user's rotation of bezel 103 to a particular position. For example, in one embodiment, indicator button 195 may remain in a retracted position (as shown in FIGS. 3A-H and FIG. 9B) except when bezel 103 is rotated such that marker 112 is located next to position 124 at which time indicator button 195 may transition to an expanded position (as shown in FIGS. 9A and 9C). When marker 112 of bezel 103 rotated away from position 124, then indicator button 195 may return to the retracted position.

As shown in FIG. 9B, heat sink 105 includes button 195 which is shown in a retracted position while bezel 103 is set to the disable position (e.g., when marker 112 is proximate position 122). Heat sink 105 also includes pin 197 fixed to bezel 103 which may rotate through a slot 196 as bezel 103 rotates. In particular, pin 197 may rotate to an end 186 of slot 196 (e.g., when marker 112 is proximate position 124) or to another end 187 of slot 196 (e.g., when marker 112 is proximate position 126).

The operation of indicator button 195 may be understood by comparing FIGS. 9B and 9C. In particular, indicator button 195 may be spring loaded by spring 199. As pin 197 rotates toward end 186 of slot 196, indicator button 195 is forced out of heat sink 105 by pin 197. Pin 197 motivates indicator button 195 by way of a groove 198 in indicator button 195. As pin 197 makes contact with groove 198, pin 197 applies outward force on a surface 188 of indicator button 195 and in turn compresses spring 199 and forces indicator button 195 outward. After lock ring 104 is locked in position 124, indicator button 195 remains locked in an expanded position as shown in FIGS. 9A and 9C.

As lock ring 104 is used to rotate pin 197 away from end 186 of slot 196, spring 199 exerts force on a pin 185 of indicator button 195 to motivate indicator button 195 back into a retracted position within heat sink 105. At this time, pin 197 exerts force on a surface 189 of indicator button 195 which assists spring 199 in returning indicator button 195 back to the retracted position.

In view of the present disclosure, it will be appreciated that various structures are provided which may be advantageously used in one or more lighting devices 100. For example, as discussed above, TIR lens 504 may be configured so as to facilitate selection of which light source provides light for lighting device 100. In addition, the inclusion of Hall effect sensors 571 and 572 may be used to facilitate the determination of which light source illuminates during operation of lighting device 100. Thus, TIR lens 504 may be switched among one or more light sources and electric power may be switched among one or more light sources. In this manner, the user may readily select which light source is used by lighting device 100 and consequently what type of light (e.g., white light, infrared light, ultraviolet light, or other light) is provided thereby.

Different types of lenses other than TIR lens 504 may be used. Thus, discussion herein regarding the use of a TIR lens is by way of example only and not by way of limitation. Any desired type of lens/reflector may be used. Any desired combination of types of lenses and/or reflectors may be used. For example, as previously described, one or more lenses (e.g., one or more substantially flat lenses and/or one or more lenses of any other desired shape) and/or one or more reflectors (e.g., one or more substantially parabolic reflectors and/or one or more reflectors of any other desired shape) may be used.

Although particular switches have been described, one or more other types of controls and/or switches may be used where appropriate.

The discussion of particular light sources herein is by way of example only and not by way of limitation. Any desired number and wavelengths of light sources may be used (e.g., white light sources, infrared light sources, ultraviolet light sources, or other light sources). Such light sources may be grouped in any desired manner. For example, one group may include only white light sources that cooperate to provide white light when white light is selected and another group may include only infrared light sources that cooperate to provide infrared light when infrared light is selected.

Embodiments are not limited to the use of LEDs as light sources. Light sources other than LEDs may be used. For example, light sources such as LEDs, arc lamps, tungsten lamps, or any other type of light sources may be used. Thus, discussion herein regarding the use of LEDs is by way of example only and not by way of limitation. Embodiments may include any desired light sources or combination of light sources.

Embodiments are not limited to use in weapon mounted lighting devices. Discussion herein of weapon mounting is by way of example only and not by way of limitation. Embodiments may be configured for use with flashlights, weapon (such as rifles and pistols) mounted lights, helmet mounted lights, headlamps, and vehicle lights. Indeed, embodiments may be used with any desired device. Thus, embodiments may provide light source switching for a variety of different applications. For example, the lighting device described herein may be configured to mount to a flashlight, a rifle or pistol, a helmet, a vehicle, or any other item. The lighting device may mount to such items via threads, mounts, adapters, or other appropriate ways.

The disclosure is not intended to limit the present invention to the precise forms or particular fields of use disclosed. It is contemplated that various alternate embodiments and/or modifications to the present invention, whether explicitly described or implied herein, are possible in light of the disclosure. For example, it is contemplated that the various embodiments set forth herein may be combined together and/or separated into additional embodiments where appropriate.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A lighting device comprising:

a plurality of light sources;

a body comprising a housing;

a head comprising:

a bezel adapted to rotate relative to the body to select between at least a first one of the light sources and a second one of the light sources, and a lens adapted to rotate eccentrically relative to a centerline of the head in response to rotation of the bezel, wherein the lens comprises a light inlet adapted to be selectively positioned over the first light source, the second light source, or neither of the light sources as the lens rotates eccentrically relative to the centerline of the head; and one or more controls adapted to adjust operation of the light sources.

2. The lighting device of claim 1, wherein the body comprises a mounting surface adapted to engage with a rail clamp mount to attach the lighting device to a weapon.

3. The lighting device of claim 2, wherein the housing is adapted to be gripped by a user to pull the lighting device toward the user while the lighting device is mounted on the weapon.

4. The lighting device of claim 1, wherein the housing comprises an external surface that is inclined relative to a direction of light provided by the lighting device, wherein at least one of the controls is positioned on the inclined external surface to permit convenient access to the one of the controls while the lighting device is mounted on a weapon.

5. The lighting device of claim 4, wherein the one of the controls is a dome switch.

6. The lighting device of claim 1, wherein the controls comprise a first rotary switch adapted to adjust operation of the first light source and a second rotary switch adapted to adjust operation of the second light source, wherein the first and second rotary switches are on substantially opposite sides of the housing.

7. The lighting device of claim 1, wherein the body comprises a connector adapted to receive a remote switch to operate at least one of the light sources.

8. The lighting device of claim 1, wherein the head comprises a lock ring adapted to be grasped by a user to rotate the bezel.

9. The lighting device of claim 8, wherein the lock ring is adapted to slide between a locked position and an unlocked position to prevent rotation of the bezel while the lock ring is in the locked position and permit rotation of the bezel while the lock ring is in the unlocked position.

10. The lighting device of claim 1, wherein the head comprises a magnet fixed relative to the bezel, wherein the magnet is adapted to rotate with the bezel.

11. The lighting device of claim 10, further comprising a Hall effect sensor adapted to detect a proximity of the magnet relative to the Hall effect sensor and provide one or more control signals to selectively switch at least one of the light sources on or off based on the detected proximity.

12. The lighting device of claim 1, wherein the light sources are light emitting diodes (LEDs).

13. The lighting device of claim 12, wherein the first light source comprises a first group of LEDs and the second light source comprises a second group of LEDs.

14. The lighting device of claim 1, wherein first light source is adapted to provide light of a first wavelength and the second light source is adapted to provide light of a second wavelength.

15. The lighting device of claim 14, wherein the first light source is a white light source and the second light source is an infrared light source.

16. The lighting device of claim 1, wherein the head further comprises an indicator button adapted to selectively expand and retract in response to the rotation of the bezel to provide tactile feedback to a user to indicate whether the first light source has been selected.

17. The lighting device of claim 16, wherein the head further comprises:

a pin adapted to rotate with the bezel to move the indicator button from a retracted position to an expanded position in response the rotation of the bezel to a selected position to select the first light source; and a spring adapted to return the indicator button to the retracted position as the pin rotates with the bezel away from the selected position.

18. The lighting device of claim 1, wherein the lens is a substantially flat lens.

19. A method of operating a lighting device, the lighting device comprising a plurality of light sources, a head comprising a bezel, a lens, and a lock ring, a body comprising a housing, and one or more controls adapted to adjust operation of the light sources, the method comprising:

urging the lock ring from a locked position to an unlocked position, wherein the lock ring is adapted to prevent rotation of the bezel while the lock ring is in the locked position and permit rotation of the bezel while the lock ring is in the unlocked position;

rotating the bezel to select a first one of the light sources or a second one of the light sources, wherein the rotating causes the lens to rotate eccentrically relative to a centerline of the head, wherein the lens comprises a light inlet adapted to be selectively positioned over the first light source, the second light source, or neither of the light sources as the lens rotates eccentrically relative to the centerline of the head; and returning the lock ring to the locked position.

20. The method of claim 19, wherein the body comprises a mounting surface adapted to engage with a rail clamp mount, the method further comprising mounting the lighting device to a weapon using the rail clamp mount.

21. The method of claim 20, wherein the housing is adapted to be gripped by a user, the method further comprising gripping the housing and pulling the lighting device toward the user while the lighting device is mounted on the weapon.

22. The method of claim 19, wherein the housing comprises an external surface that is inclined relative to a direction of light provided by the lighting device, wherein at least one of the controls is positioned on the inclined external surface to permit convenient access to the one of the controls while the lighting device is mounted on a weapon, the method further comprising adjusting operation of the selected one of the light sources using the one of the controls.

23. The method of claim 22, wherein the one of the controls is a dome switch.

24. The method of claim 19, wherein the controls comprise a first rotary switch adapted to operate the first light source and a second rotary switch adapted to operate the second light source, wherein the first and second rotary switches are on substantially opposite sides of the housing, the method further comprising adjusting operation of the selected one of the light sources using one of the rotary switches.

25. The method of claim 19 wherein the body comprises a connector adapted to receive a remote switch to operate at least one of the light sources, the method further comprising:

attaching the remote switch to the lighting device through the connector; and adjusting operation of the selected one of the light sources using the remote switch.

26. The method of claim 19, wherein the head comprises a magnet fixed relative to the bezel, wherein the magnet is adapted to rotate with the bezel.

27. The method of claim 26, wherein the lighting device further comprises a Hall effect sensor adapted to detect a proximity of the magnet relative to the Hall effect sensor and provide one or more control signals to selectively switch at least one of the light sources on or off based on the detected proximity as the rotating is performed.

28. The method of claim 19, wherein the light sources are light emitting diodes (LEDs).

29. The method of claim 28, wherein the first light source comprises a first group of LEDs and the second light source comprises a second group of LEDs.

30. The method of claim 19, wherein first light source is adapted to provide light of a first wavelength and the second light source is adapted to provide light of a second wavelength.

31. The method of claim 30, wherein the first light source is a white light source and the second light source is an infrared light source.

32. The method of claim 19, wherein the lens is a substantially flat lens.

33. A lighting system comprising:

a lighting device comprising:

a plurality of light sources, a body comprising a housing, a connector, and a mounting surface, a head comprising:

a bezel adapted to rotate relative to the body to select between at least a first one of the light sources and a second one of the light sources, and a lens adapted to rotate eccentrically relative to a centerline of the head in response to rotation of the bezel, wherein the lens comprises a light inlet adapted to be selectively positioned over the first light source, the second light source, or neither of the light sources as the lens rotates eccentrically relative to the centerline of the head, and one or more controls adapted to adjust operation of the light sources;

a remote switch, wherein the connector is adapted to receive the remote switch to control at least one of the light sources; and a rail clamp mount, wherein the mounting surface is adapted to engage with the rail clamp mount to attach the lighting device to a weapon.

34. A lighting device comprising:

a plurality of light sources;

a body comprising a housing;

a head comprising:

a bezel adapted to rotate relative to the body to select between at least a first one of the light sources and a second one of the light sources, and a reflector adapted to rotate eccentrically relative to a centerline of the head in response to rotation of the bezel, wherein the reflector comprises a light inlet adapted to be selectively positioned over the first light source, the second light source, or neither of the light sources as the reflector rotates eccentrically relative to the centerline of the head; and one or more controls adapted to adjust operation of the light sources.

35. The lighting device of claim 34, wherein the reflector is a substantially parabolic reflector.

* * * * *